US009658562B2

(12) United States Patent
Watanabe et al.

(10) Patent No.: US 9,658,562 B2
(45) Date of Patent: May 23, 2017

(54) IMAGE FORMING APPARATUS AND OPTICAL SCANNING APPARATUS FOR SCANNING PHOTOSENSITIVE MEMBER WITH LIGHT SPOT

(71) Applicant: CANON KABUSHIKI KAISHA, Tokyo (JP)

(72) Inventors: Shuhei Watanabe, Yokohama (JP); Hidenori Kanazawa, Mishima (JP); Takashi Kawana, Machida (JP); Junya Kobayashi, Mishima (JP); Hiroyuki Fukuhara, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/040,448

(22) Filed: Feb. 10, 2016

(65) Prior Publication Data

US 2016/0246209 A1 Aug. 25, 2016

(30) Foreign Application Priority Data

Feb. 19, 2015 (JP) ..... 2015-031055
Feb. 19, 2015 (JP) ..... 2015-031056

(51) Int. Cl.
*G03G 15/00* (2006.01)
*G03G 15/043* (2006.01)
*G03G 15/04* (2006.01)

(52) U.S. Cl.
CPC ..... *G03G 15/043* (2013.01); *G03G 15/04072* (2013.01); *G03G 15/556* (2013.01)

(58) Field of Classification Search
CPC ..... G03G 15/043; G03G 15/04072; G03G 15/0131; G03G 15/0266; G03G 15/0415
(Continued)

(56) References Cited

U.S. PATENT DOCUMENTS 4,532,552 A 7/1985 Uno ..... 358/302
5,463,473 A 10/1995 Yamada et al. ..... 358/300
(Continued)

FOREIGN PATENT DOCUMENTS

JP S58-125064 7/1983
JP H08-101357 4/1996
(Continued)

OTHER PUBLICATIONS

U.S. Appl. No. 15/169,402, filed May 31, 2016.
(Continued)

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes: a scanning unit configured to form a latent image on a photosensitive member, wherein a scanning speed changes within a scan line; a control unit configured to perform correction control of a luminance and a light-emitting time of a light source; a holding unit configured to hold profile information indicating a change of the light spot due to an environment or due to a position of the pixel. The holding unit is further configured to hold scanning information indicating the light-emitting time of the light source or the luminance of the light source with respect to a pixel, for correcting a change in the scanning time of the pixel, and the control unit is further configured to perform the correction control based on the scanning information and the profile information.

30 Claims, 23 Drawing Sheets

(58) Field of Classification Search
USPC ..... 399/4, 44, 47, 51, 52
See application file for complete search history.

(56) References Cited

U.S. PATENT DOCUMENTS

| | | | | |
|---|---|---|---|---|
| 5,465,157 | A | 11/1995 | Seto et al. | 358/298 |
| 5,495,341 | A | 2/1996 | Kawana et al. | 358/298 |
| 5,565,995 | A | 10/1996 | Yamada et al. | 358/298 |
| 5,586,227 | A | 12/1996 | Kawana et al. | 395/112 |
| 5,627,651 | A | 5/1997 | Seto et al. | 358/298 |
| 5,696,853 | A | 12/1997 | Kawana et al. | 382/299 |
| 5,760,811 | A | 6/1998 | Seto et al. | 347/131 |
| 9,128,291 | B2 | 9/2015 | Nagatoshi et al. | G02B 26/121 |
| 2011/0169906 | A1* | 7/2011 | Suzuki | B41J 2/473 347/224 |
| 2011/0228029 | A1* | 9/2011 | Miyadera | B41J 2/473 347/118 |
| 2012/0307317 | A1* | 12/2012 | Uchida | H04N 1/4076 358/461 |
| 2013/0222870 | A1* | 8/2013 | Iwami | H04N 1/00018 358/504 |
| 2015/0338768 | A1 | 11/2015 | Nagatoshi et al. | G03G 15/043 |

FOREIGN PATENT DOCUMENTS

| | | |
|---|---|---|
| JP | H11-265106 | 9/1999 |
| JP | 2000-190554 | 7/2000 |
| JP | 2001-066524 | 3/2001 |
| JP | 2005-096351 | 4/2005 |
| JP | 2006-171318 | 6/2006 |

OTHER PUBLICATIONS

U.S. Appl. No. 15/040,436, filed Feb. 10, 2016; Inventors: Osamu Nagasaki, Go Araki, Hidenori Kanazawa.
U.S. Appl. No. 14/927,156, filed Oct. 29, 2015; Inventors: Akira Nakamura, Yoshihiko Tanaka, Hiroyuki Fukuhara.

* cited by examiner

IMAGE FORMING APPARATUS AND OPTICAL SCANNING APPARATUS FOR SCANNING PHOTOSENSITIVE MEMBER WITH LIGHT SPOT

BACKGROUND OF THE INVENTION

Field of the Invention

The present invention relates to an image forming apparatus and an optical scanning apparatus, such as a laser beam printer, a copy machine or a fax machine, that form an image by scanning light.

Description of the Related Art

There are image forming apparatuses that form an image by exposing a photosensitive member. Furthermore, some of these image forming apparatuses form a light spot on the surface of the photosensitive member by reflecting light with a rotating polygon mirror and focusing the reflected light using a scanning lens. By rotating the rotating polygon mirror, the light spot moves over the surface of the photosensitive member in a main scanning direction (direction orthogonal to a circumferential direction of the photosensitive member), and thereby forms a latent image on the photosensitive member.

Note that lenses having fθ characteristics are mainly used as the scanning lens. This is to ensure that the light spot moves at a uniform speed over the surface of the photosensitive member, when the rotating polygon mirror rotates at a uniform angular velocity. However, scanning lenses having fθ characteristics are comparatively large and costly. Thus, configurations that do not using a scanning lens or that use a scanning lens that does not have fθ characteristics are being considered with the aim of reducing the size and cost of image forming apparatuses. Japanese Patent Laid-Open No. 58-125064 discloses a configuration that changes the clock frequency during the scanning of one scan line, such that dots that are formed on the surface of the photosensitive member have a constant width, even when the light spot does not move over the surface of the photosensitive member at a uniform speed.

Image forming apparatuses are required to perform exposure that suppresses image distortion by making a LSF (Line Spread Function) profile of each pixel (dot) uniform in the main scanning direction. This still applies even when not using a scanning lens having fθ characteristics.

SUMMARY OF THE INVENTION

According to an aspect of the present invention, an image forming apparatus includes: a photosensitive member; a scanning unit configured to form a latent image on the photosensitive member, by forming a light spot on the photosensitive member with light emitted by a light source and scanning the light spot, wherein a scanning speed at which the photosensitive member is scanned with the light spot changes within a scan line; a control unit configured to perform correction control of a luminance and a light-emitting time of the light source, according to a pixel to be exposed; a holding unit configured to hold profile information indicating a change of the light spot due to an environment or due to a position of the pixel. The holding unit is further configured to hold scanning information indicating the light-emitting time of the light source or the luminance of the light source with respect to the pixel, for correcting a change in the scanning time of the pixel due to a change in the scanning speed, and the control unit is further configured to perform the correction control based on the scanning information and the profile information.

Further features of the present invention will become apparent from the following description of exemplary embodiments with reference to the attached drawings.

DESCRIPTION OF THE EMBODIMENTS

Hereinafter, illustrative embodiments of the present invention will be described with reference to the drawings. Note that the following embodiments are illustrative, and it is not intended to limit the present invention to the contents of the embodiments. Also, in the following diagrams, constituent elements that are not required in describing the embodiments are omitted from the diagrams.

First Embodiment

Figure 1:
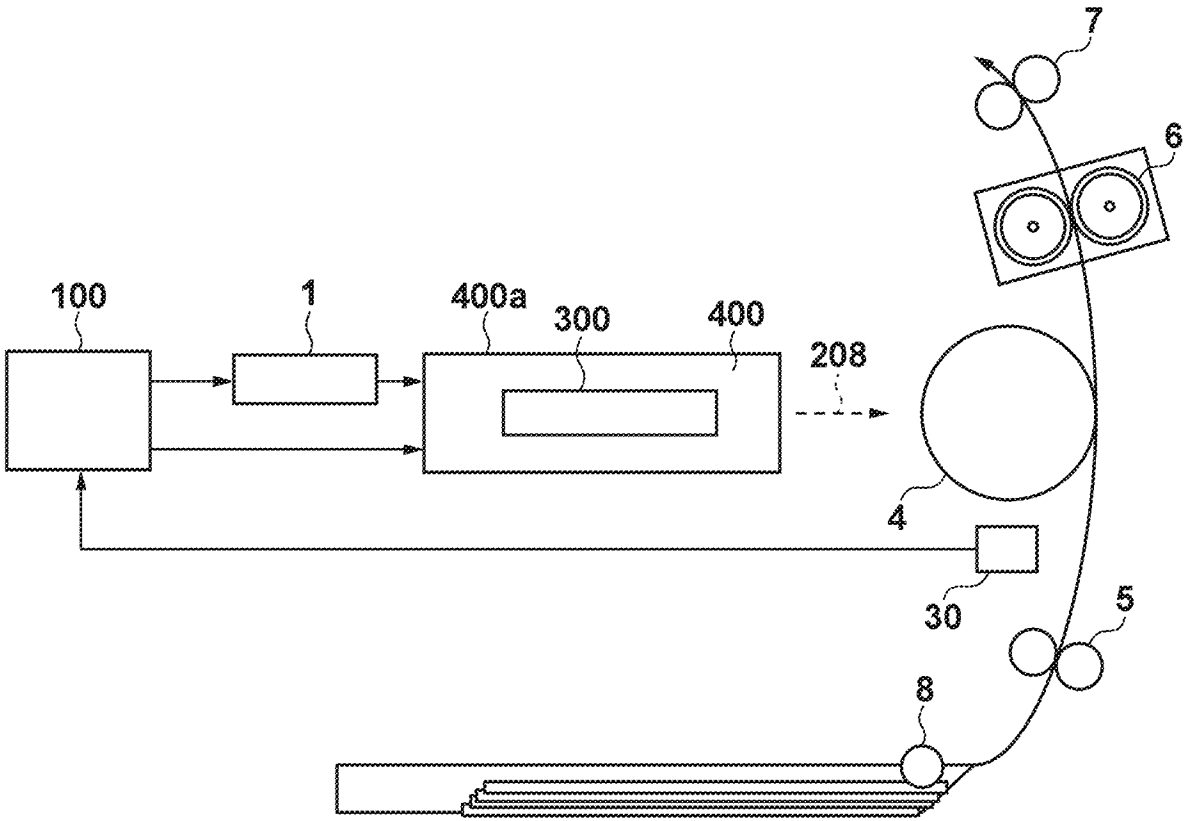
FIG. 1 is a schematic view of an image forming apparatus according to one embodiment.

FIG. 1 is a schematic configuration diagram of an image forming apparatus according to the present embodiment. An optical scanning apparatus 400 emits a scan light 208 (hereinafter, light 208), based on an image signal from an image signal generation unit 100 and a control signal from a control unit 1. The optical scanning apparatus 400 is provided with a drive unit 300 for driving a light source, and is housed in a casing 400*a*. The surface of a photosensitive member 4 is charged to a uniform potential by a charging unit that is not illustrated. By scanning and exposing this photosensitive member 4 with the light 208, an electrostatic latent image is formed on the surface of the photosensitive member 4. A developing unit that is not illustrated causes a developer to adhere to this electrostatic latent image and visualizes the electrostatic latent image as a developer image. This developer image is transferred to a recording medium such as paper or the like that is fed from a feeding unit 8 and conveyed with a roller 5 to a position in contact with the photosensitive member 4. The developer image transferred to the recording medium is heat fixed to the recording medium by a fixing device 6, and the recording medium is discharged to outside the apparatus through discharge rollers 7. Also, the image forming apparatus is provided with a density detection sensor 30 (Hereinafter referred to as sensor 30) that detects the density of the developer image formed on the surface of the photosensitive member 4.

Figure 2A:
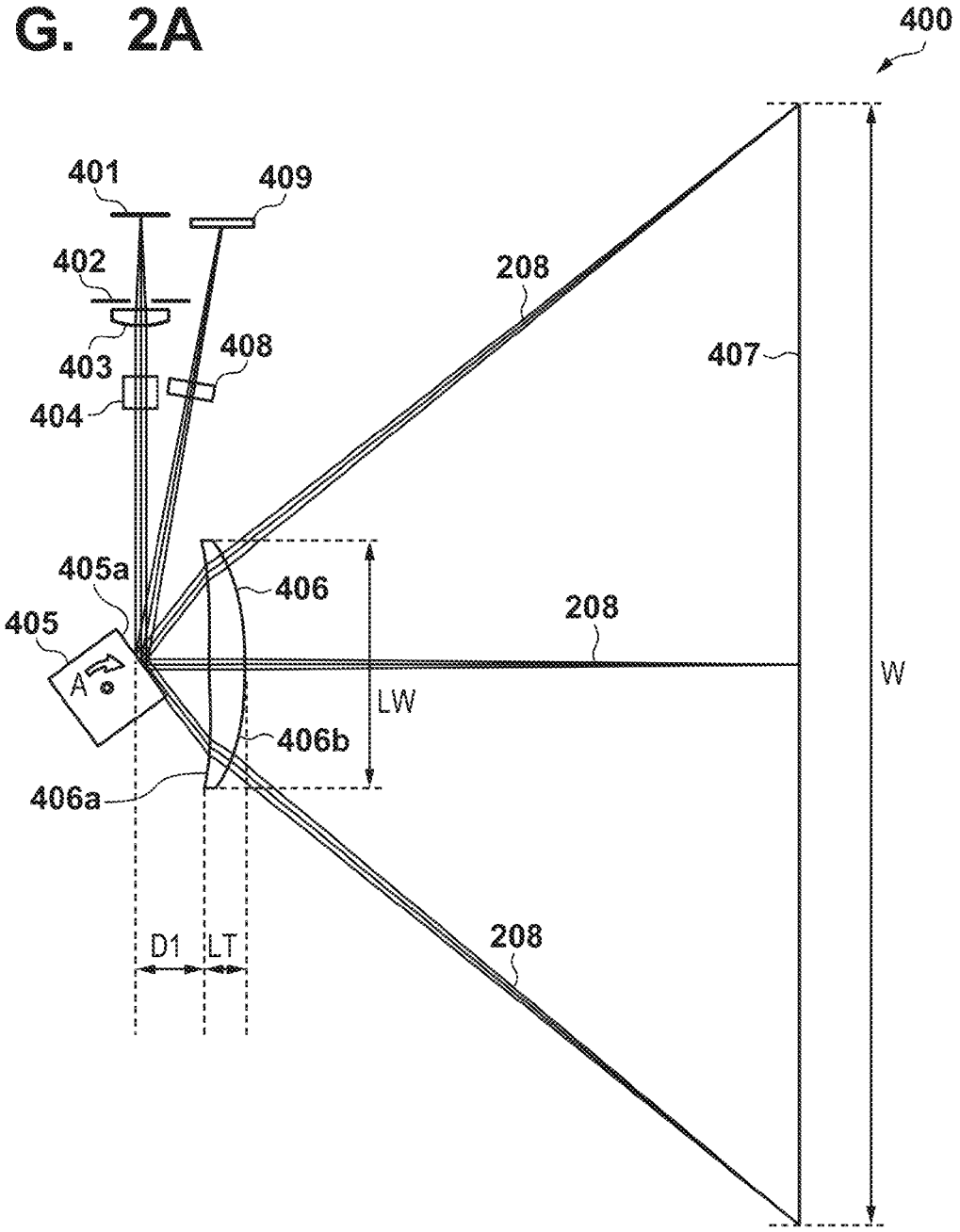
FIGS. 2A and 2B are cross-sectional views of an optical scanning apparatus according to one embodiment.
Figure 2B:
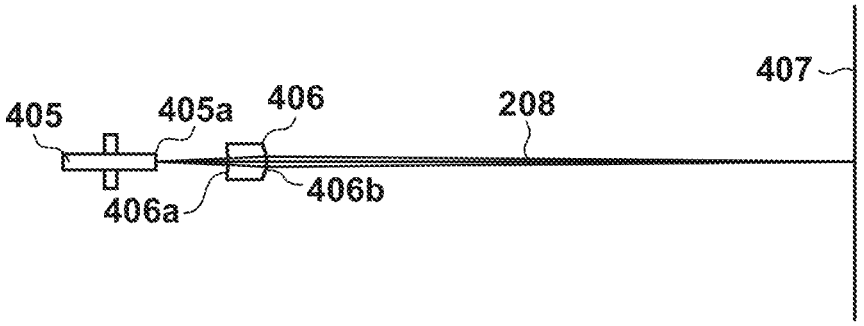

FIGS. 2A and 2B are configuration diagrams of the optical scanning apparatus 400 according to the present embodiment, with FIG. 2A showing a main scanning cross-section, and FIG. 2B showing a sub-scanning cross-section. Note that the main scanning direction is the direction in which the light 208 is scanned on the surface of the photosensitive member 4, and the sub-scanning direction is the direction orthogonal to the main scanning direction on the surface of the photosensitive member 4. In the present embodiment, the light (light beam) 208 emitted from a light source 401 is formed into an elliptical shape by an aperture diaphragm 402 and is incident on a coupling lens 403. Light that has passed through the coupling lens 403 is converted to substantially parallel light and is incident on an anamorphic lens 404. Note that substantially parallel light includes weak convergent light and weak divergent light. The anamorphic lens 404 has positive refractive power within the main scanning cross-section, and converts an incident light beam into convergence light within the main scanning cross-section. Also, the anamorphic lens 404, within the sub-scanning cross-section, focuses the light beam to near a deflection surface 405*a* of a deflector 405, and forms a long line image in the main scanning direction.

Light that has passed through the anamorphic lens 404 is reflected by the deflection surface or reflection surface 405*a* of the deflector (rotating polygon mirror) 405. The light 208 reflected by the deflection surface 405*a* passes through an imaging lens 406, and forms a light spot on a scan surface 407 of the photosensitive member 4. The imaging lens 406 is an imaging optical element. In the present embodiment, an imaging optical system is constituted by only a single imaging optical element (imaging lens 406). By rotating the deflector 405 at a constant angular velocity in the direction of arrow A using a drive unit that is not illustrated, the light spot moves in the main scanning direction over the scan surface 407, and thereby scans the photosensitive member 4. As shown in FIG. 2A, the light spot scans a distance W over the scan surface 407 of the photosensitive member 4 in the main scanning direction and exposes the pixels of one scan line. As a result of the surface of the photosensitive member 4 moving in the sub-scanning direction due to the rotation of the photosensitive member 4 and exposing a plurality of scan lines in the sub-scanning direction, an electrostatic latent image is formed on the scan surface 407.

A beam detector (BD) sensor 409 and a BD lens 408 constitute a synchronization optical system that determines the timing for writing the electrostatic latent image onto the scan surface 407. Light that has passed through the BD lens 408 is incident on the BD sensor 409, which includes a photodiode, and is detected. The write timing is controlled, based on the timing at which light is detected by the BD sensor 409.

The light source 401 is, for example, a semiconductor laser. The light source 401 of the present embodiment is provided with one light-emitting unit. However, it is possible to use a light source 401 provided with a plurality of light-emitting units whose light emission can be controlled independently. In the case where a plurality of light-emitting units are provided, the plurality of light beams that are generated each arrive at the scan surface 407 via the coupling lens 403, the anamorphic lens 404, the deflector 405, and the imaging lens 406. On the scan surface 407, light spots corresponding to the light beams are respectively formed at positions shifted in the sub-scanning direction. Note that the various optical members of the optical scanning apparatus 400 including the light source 401, the coupling lens 403, the anamorphic lens 404, the imaging lens 406 and the deflector 405 mentioned above are housed in the casing 400*a* shown in FIG. 1.

As shown in FIG. 2A, the imaging lens 406 has two optical surfaces consisting of an incident surface 406*a* and an emission surface 406*b*. The imaging lens 406 causes the light deflected by the deflection surface 405*a* to be scanned with a predetermined scan characteristic on the scan surface 407. Also, the imaging lens 406 forms the light spot on the scan surface 407 into a predetermined shape. Also, a conjugate relationship is established near the deflection surface 405*a* and near the scan surface 407 by the imaging lens 406 within the sub-scanning cross-section. The imaging lens 406 is thereby configured to compensate for surface tilt, that is, reduce scanning position shift on the scan surface 407 in the sub-scanning direction that occurs when the deflection surface 405*a* has tilted.

Also, although the imaging lens 406 according to the present embodiment is a plastic molded lens formed by injection molding, a glass molded lens may be employed as the imaging lens 406. Since the aspheric surface shape of molded lenses is easily formed and molded lenses are suited to mass production, an improvement in productivity and optical performance can be achieved by employing a molded lens as the imaging lens 406.

The imaging lens 406 according to the present embodiment is not a lens having so-called fθ characteristics. In other words, the light spot does not move at a uniform speed on the scan surface 407 when the deflector 405 is rotated at a uniform angular velocity. By using the imaging lens 406 that does not have fθ characteristics, it is thus possible to shorten a distance D1 in FIG. 2A, that is, to dispose the imaging lens 406 close to the deflector 405. Also, with the imaging lens 406 that does not have fθ characteristics, a length LW in the main scanning direction and a thickness LT in the optical axis direction are shorter than in an imaging lens having fθ characteristics. Therefore, the casing 400*a* of the optical scanning apparatus 400 can be miniaturized as a result of the imaging lens 406 that does not have fθ characteristics. Also, there are lens having fθ characteristics in which the shapes of the incident surface and the emission surface of the lens change steeply in the main scanning cross-section, and favorable imaging performance may possibly not be obtained. In contrast, the imaging lens 406 that does not have fθ characteristics has a shape that exhibits little such steep change, and, therefore, favorable imaging performance can be obtained.

The scan characteristic of the scan surface 407 due to the imaging lens 406 of the present embodiment is expressed with the following equation (1).

$$Y=K/B\cdot\tan(B\cdot\theta) \quad (1)$$

Y in equation (1) is the position (image height) of the light spot on the scan surface 407 in the main scanning direction, and Y=0 in the case where the light spot is on the optical axis (hereinafter, simply "on-axis"), that is, in the case where the light spot is in the center of the scan line. Also, θ in equation (1) is the scanning angle (scanning field angle) of the deflector 405, and θ=0 corresponds to the case where the light spot is on the optical axis. Furthermore, K in equation (1) is the on-axis imaging coefficient, and B is the scan characteristic coefficient that determines the scan characteristic of the imaging lens 406. With the imaging lens 406, the light spot scans a range of Y=−Ymax to +Ymax. Also, in FIG. 2A, Ymax is W/2. Hereinafter, the maximum absolute value of the image height Y, that is, Y=−Ymax and Ymax, will be called the maximum image height. Also, the image height Y=0 will be called the on-axis image height.

When equation (1) is differentiated with the scanning angle θ, the following equation (2) showing the movement speed, that is, the scanning speed, of the light spot with respect to the position of the scan surface 407 in the main scanning direction is obtained.

$$dY/d\theta=K/(\cos^2(B\cdot\theta)) \quad (2)$$

From equation (2), the scanning speed of the light spot when θ=0. that is, at the on-axis image height, is K. When equation (2) is divided by K, the following equation (3) is obtained.

$$(dY/d\theta)/K=1/(\cos^2(B\cdot\theta)) \quad (3)$$

Equation (3) represents the ratio of the scanning speed of the light spot at each scanning angle to the scanning speed of the light spot at the on-axis image height. Note that since the image height and the scanning angle correspond, equation (3) shows the ratio of the scanning speed of the light spot at the on-axis image height and the scanning speed of the light spot at each image height. The following equation (4), which is obtained by subtracting 1 from equation (1), therefore shows the shift amount (hereinafter, partial magnification) of the scanning speed at each image height relative to the scanning speed of the light spot at the on-axis image height.

$$(dY/d\theta)/K=(1/(\cos^2(B\cdot\theta))-1=\tan^2(B\cdot\theta) \quad (4)$$

It is evident from equations (3) and (4) that with the imaging lens 406 according to the present embodiment, the scanning speed of the light spot changes depending on the image height of the deflector 405. In other words, with the optical scanning apparatus 400 according to the present embodiment, the scanning speed changes within the scan line.

Figure 3:
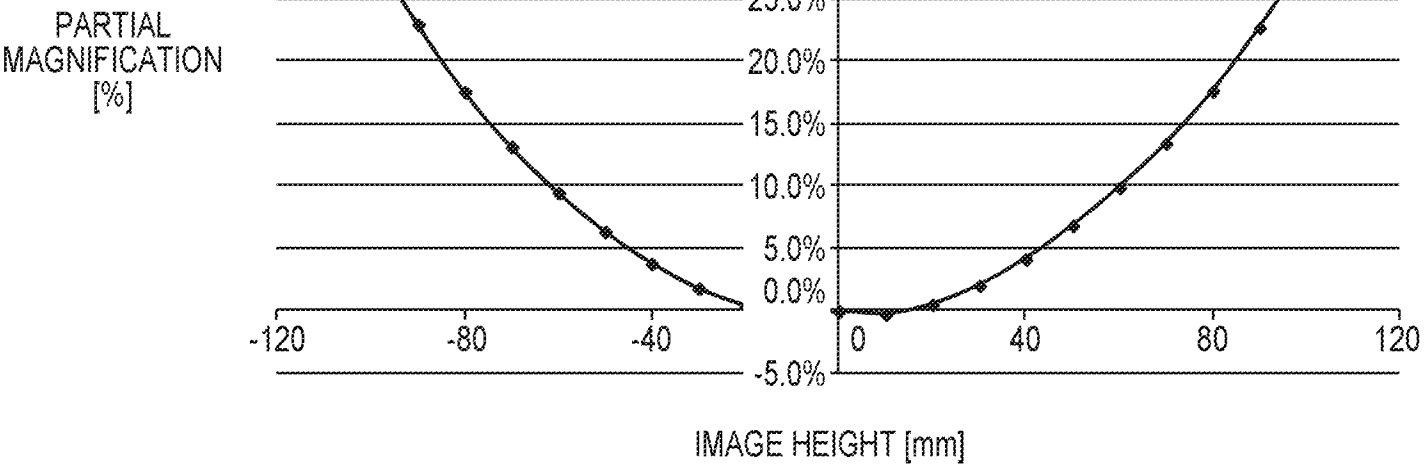
FIG. 3 is a diagram showing partial magnification with respect to image height of an optical scanning apparatus according to one embodiment.

FIG. 3 shows a graph of partial magnification with respect to image height. As shown in FIG. 3, when the absolute value of the image height Y increases, the partial magnification increases because of the increase in scanning speed. For example, in the case where light is irradiated for a unit of time when the partial magnification is 30 percent, the irradiation length on the scan surface 407 in the main scanning direction increases to 1.3 times the on-axis length. Accordingly, in the case where the pixel width in the main scanning direction is determined by a constant time interval determined by the period of the image clock, pixel densities will differ according to the main scanning direction position of the light spot. Furthermore, when the emission luminance of the light source 401 is constant, the exposure amount will differ according to the scanning position of the light spot, due to the difference in scanning speed. Specifically, the exposure amount per unit length decreases as the scanning speed increases. Accordingly, in order to obtain favorable image quality, correction of partial magnification and luminance correction for correcting the total exposure amount per unit length need to be performed.

Figure 4:
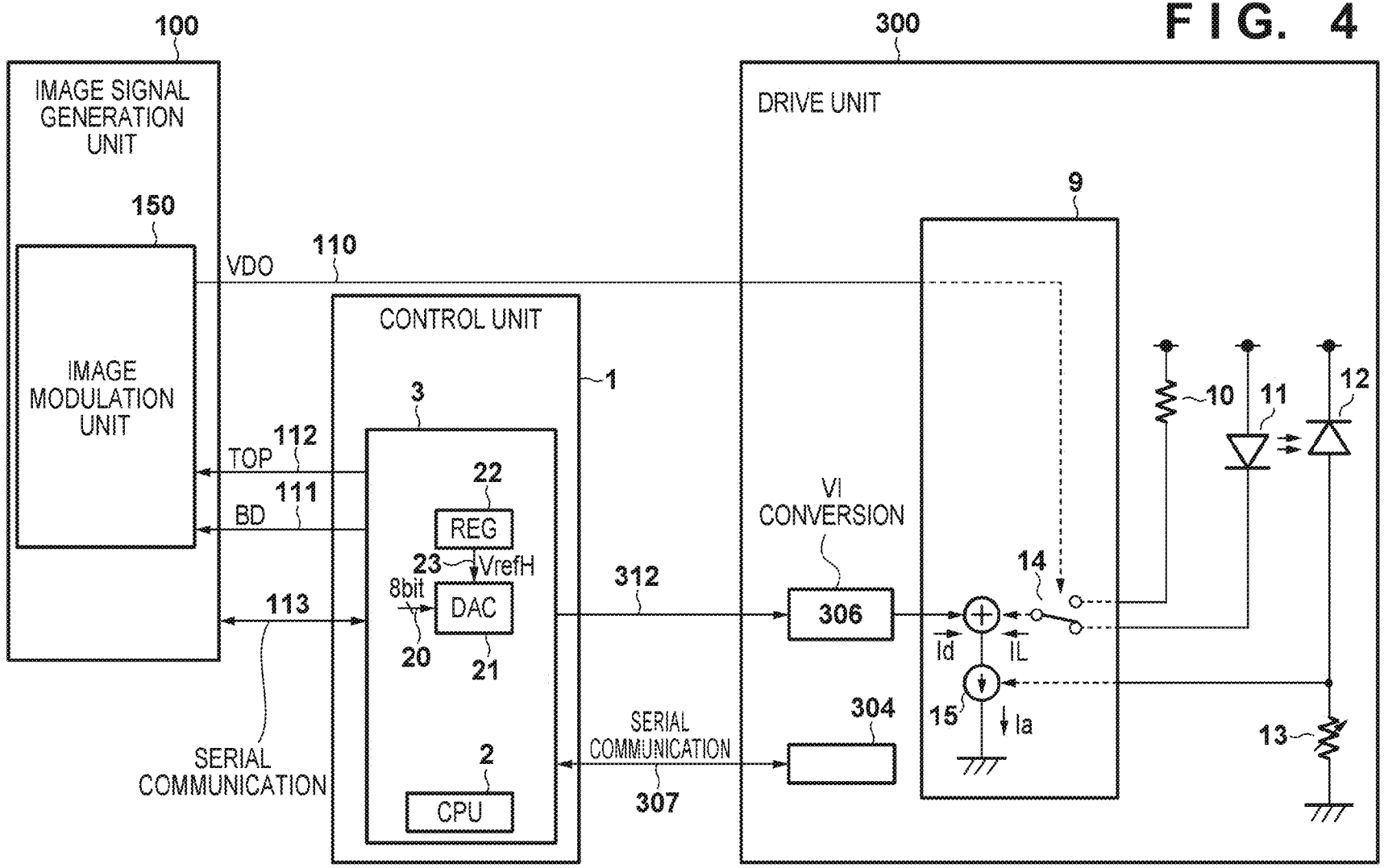
FIG. 4 is a diagram showing an exposure control configuration according to one embodiment.

FIG. 4 is a configuration diagram of exposure control of the image forming apparatus according to the present embodiment. The image signal generation unit 100 receives print information from a host computer that is not illustrated, and generates a VDO signal 110 corresponding to image data (image signal). The control unit 1 controls the image forming apparatus. Note that the control unit 1 also controls the luminance (light emission intensity) of the light source 401 by controlling the drive unit 300. The drive unit 300 causes a light-emitting unit 11 of the light source 401 to emit light, by supplying current to the light-emitting unit 11 of the light source 401 based on the VDO signal 110.

The image signal generation unit 100 instructs the control unit 1 to start printing, using serial communication 113, when preparation for outputting an image signal for image formation is complete. The control unit 1 transmits a TOP signal 112, which is a synchronization signal in the sub-scanning direction, and a BD signal 111, which is a synchronization signal in the main scanning direction, to the image signal generation unit 100, when preparation for printing is complete. The image signal generation unit 100 outputs the VDO signal 110, which is the image signal, to the drive unit 300 at a predetermined timing when the synchronization signals are received. The configuration blocks within the image signal generation unit 100, the control unit 1 and the drive unit 300 shown in FIG. 4 will be discussed in detail later.

Figure 5A:
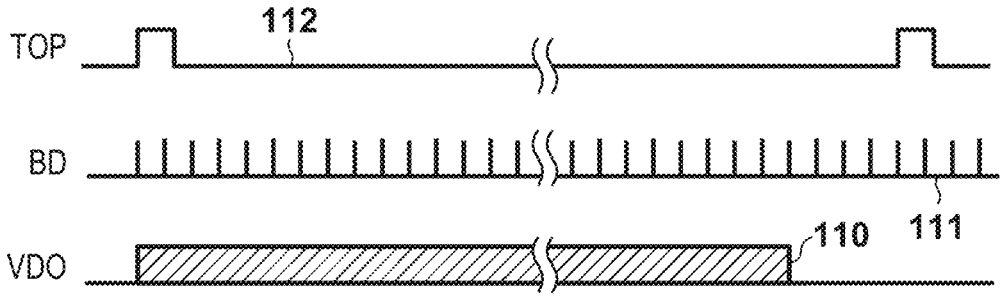
FIGS. 5A and 5B are timing charts of image formation according to one embodiment.

FIG. 5A is a timing chart of the synchronization signals and the image signal when an image formation operation equivalent to one page of a recording medium is performed. Note that time elapses from left to right in the diagram. "HIGH" of the TOP signal 112 indicates that the leading edge of the recording medium has reached a predetermined position. The image signal generation unit 100 transmits the VDO signal 110 in synchronization with the BD signal 111, when "HIGH" of the TOP signal 112 is received. Based on this VDO signal 110, the light source 401 emits light and forms an electrostatic latent image on the photosensitive member 4. Note that, in FIG. 5A, the VDO signal 110 is shown as being continuously output over the span of a plurality of BD signals 111 in order to simplify the diagram. However, the VDO signal 110 is actually output for a predetermined period from when the BD signal 111 is output until when the next BD signal 111 is output. Also, the BD signal 111 is a signal indicating a reference for the start timing of each scan line.

Figure 6A:
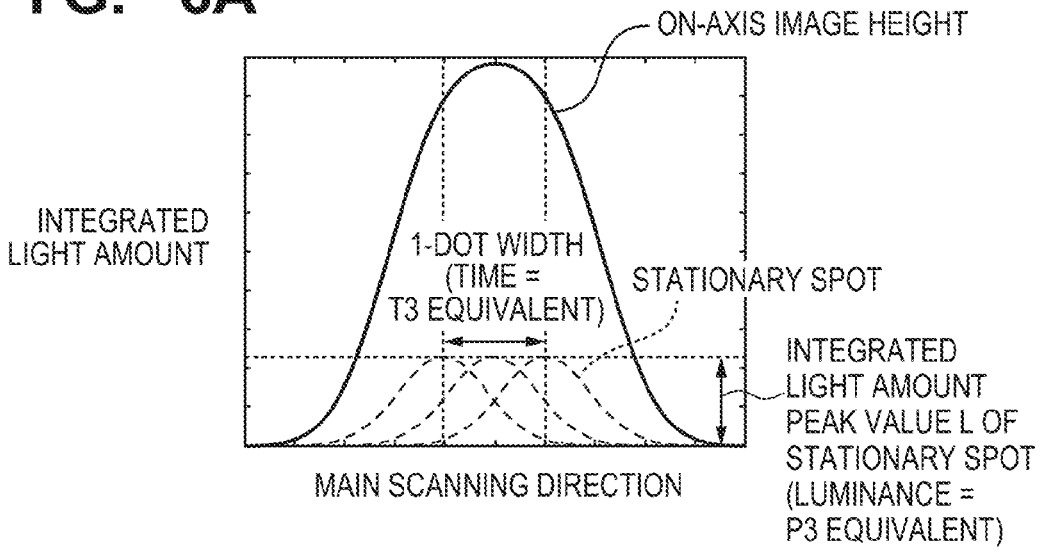
FIGS. 6A to 6C are diagrams showing profiles of light spots that are formed by the optical scanning apparatus according to one embodiment.
Figure 6B:
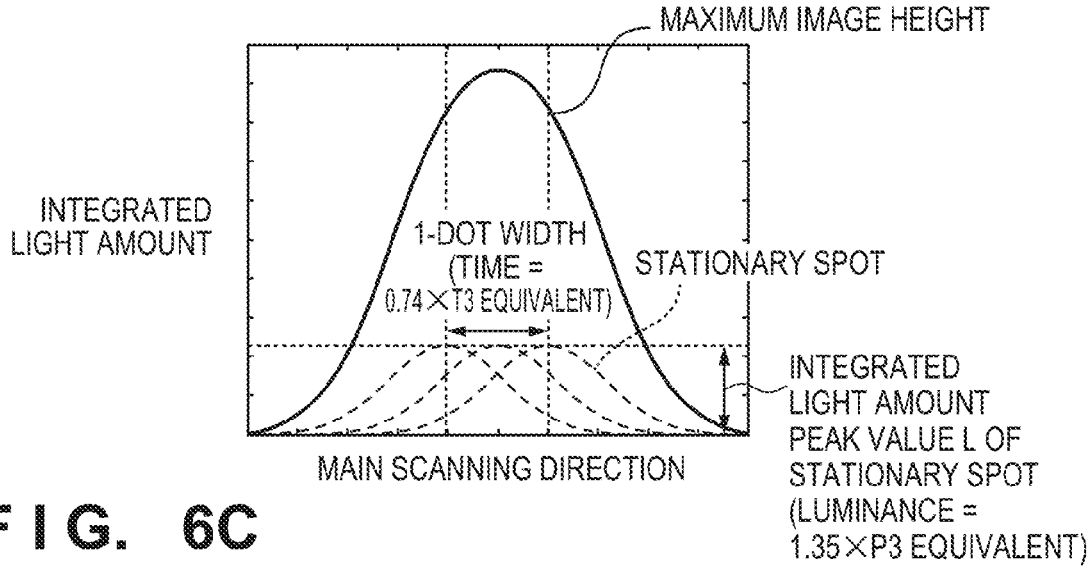
Figure 6C:
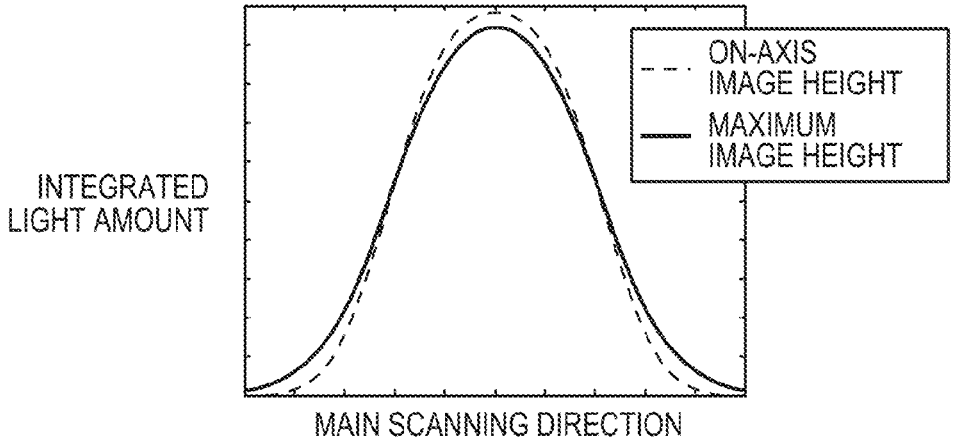

FIGS. 6A to 6C show LSF profiles of single pixels (dots) in the main scanning direction in the case where partial magnification correction and luminance correction as described in Japanese Patent Laid-Open No. 58-125064 has been performed. FIG. 6A shows the LSF profile at the on-axis image height, that is, Y=0. and FIG. 6B shows the LSF profile at the maximum image height, that is, Y=Ymax. Furthermore, FIG. 6C shows the LSF profiles of FIGS. 6A and 6B superimposed on each other. In FIGS. 6A to 6C, the LSF profiles have a resolution of 600 dpi and a 1-dot width in the main scanning direction of 42.3 um. Note that the partial magnification at the maximum image height is 35 percent. With the configuration of Japanese Patent Laid-Open No. 58-125064. in the case where light emission at the on-axis image height is performed for time T3 at a luminance P3, light emission at the maximum image height is performed for time 0.74×T3 at a luminance 1.35×P3. On comparison of the 1-dot LSF profiles at the on-axis image height and the maximum image height, as shown in FIG. 6C, at the maximum image height, the peak integrated light amount is lower and the profile is wider at the bottom than at the on-axis image height. In other words, the LSF profiles do not coincide. More specifically, the LSF profiles differ depending on the position of the image height, that is, the light spot in the main scanning direction.

The LSF profiles thus differing depending on image height is due to the profiles of the stationary spots respectively shown with the dashed lines in FIGS. 6A and 6B differing depending on image height. Note that the profile of a stationary spot is the profile of the light spot at a given moment. In other words, a 1-pixel LSF profile is obtained by integrating the profiles of light spots within one pixel.

With the configuration described in Japanese Patent Laid-Open No. 58-125064. the LSF profiles differing depending on image height is due to the shapes (profiles) of the stationary spots produced at each moment on the scan surface 407 by the imaging lens 406 differing depending on image height. Therefore, in the present embodiment, correction of the light-emitting time of the light source 401 (light-emitting time correction) is performed, in addition to partial magnification correction and luminance correction. The reproducibility of detailed images is thereby improved.

Figure 7A:
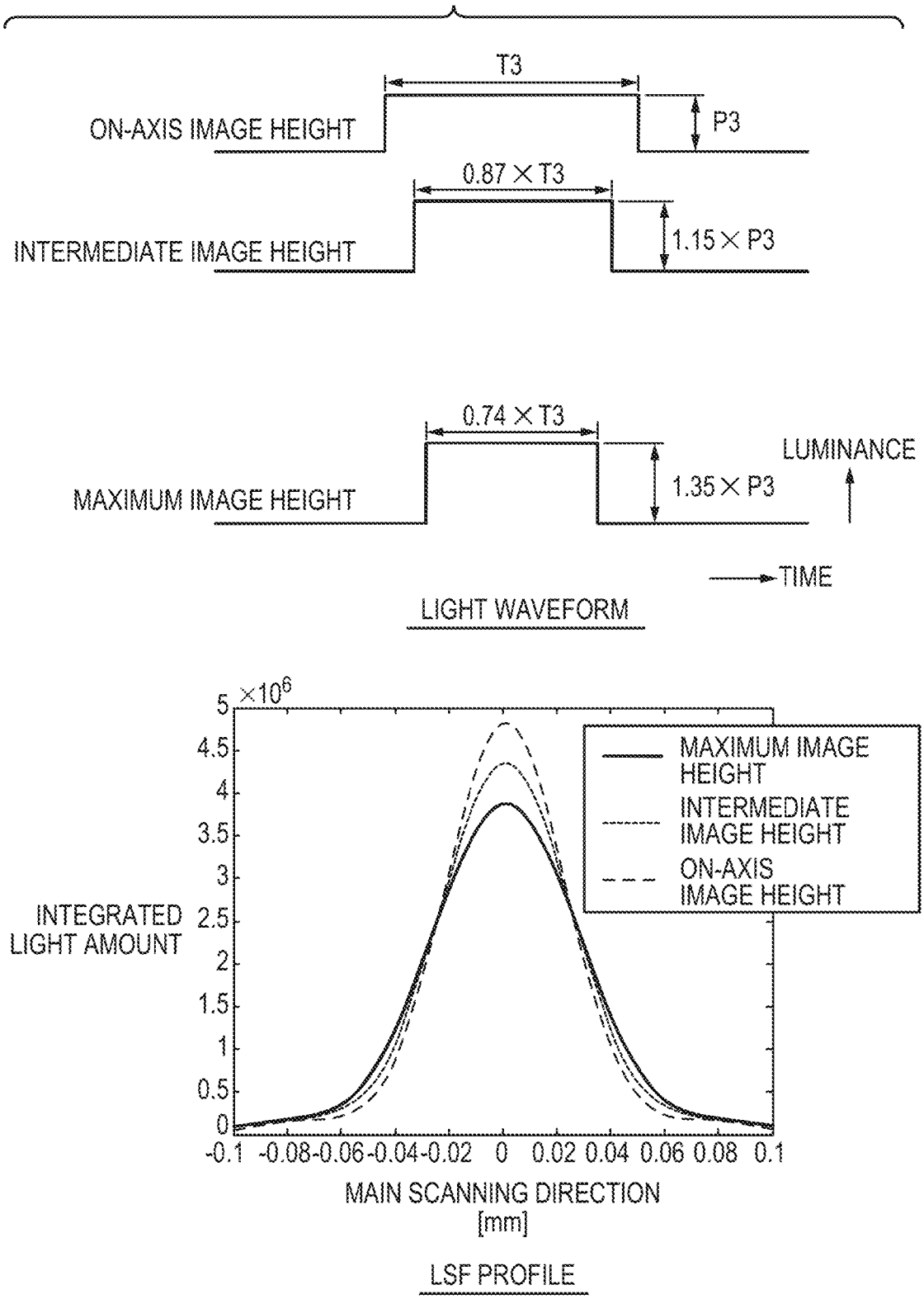
FIGS. 7A and 7B are diagrams showing LSF profiles together with light-emitting time and luminance according to one embodiment.
Figure 7B:
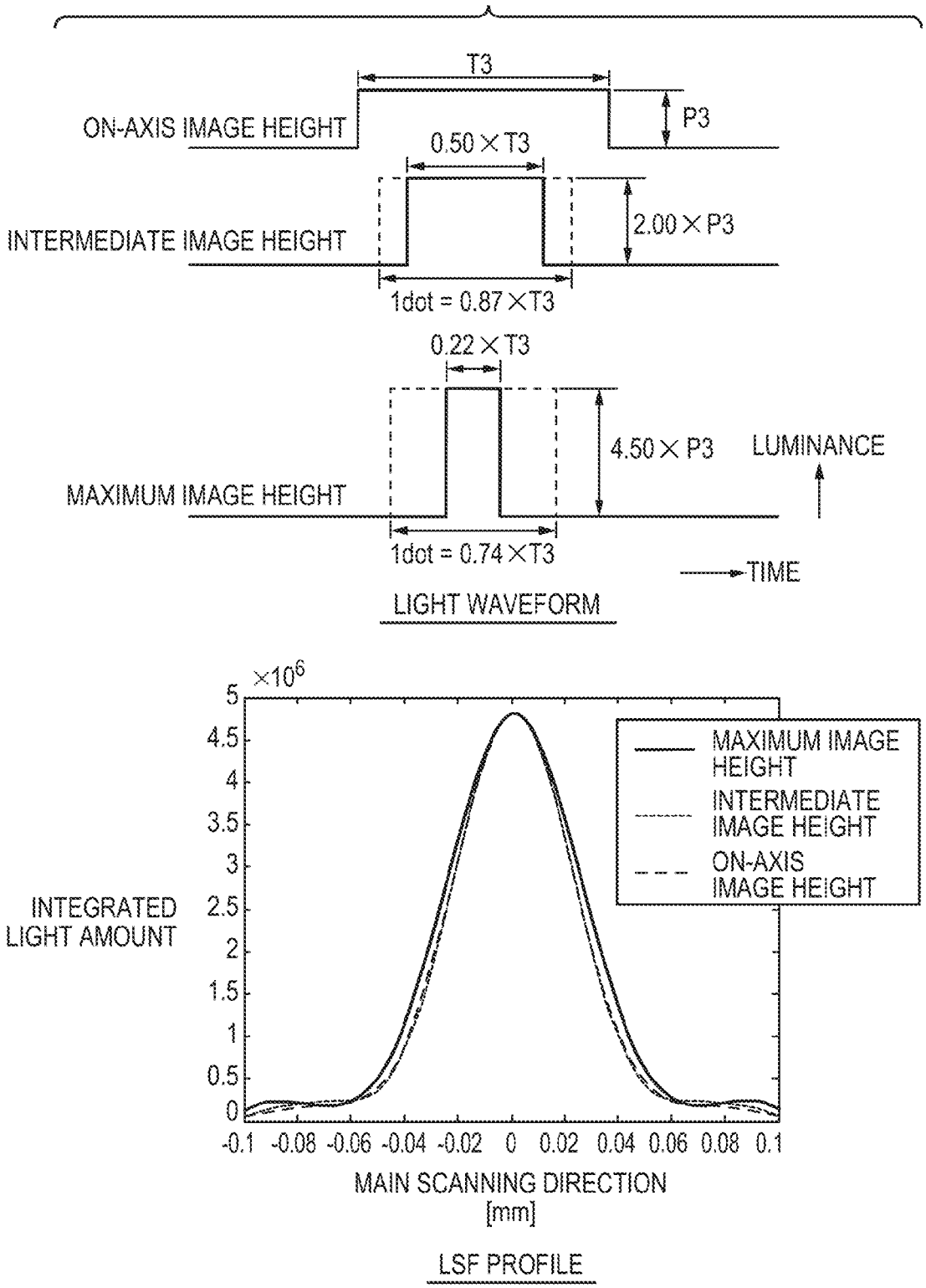

FIG. 7A shows light waveforms and LSF profiles for one dot according to Japanese Patent Laid-Open No. 58-125064. and FIG. 7B shows light waveforms and LSF profiles for one dot according to the present embodiment. Here, the light waveform shows the light-emitting time and the luminance for one dot, and three light waveforms are shown for on-axis image height, intermediate image height and maximum image height. Note that intermediate image height is an image height between the on-axis image height and the maximum image height. Note that, in FIGS. 7A and 7B, the scanning time of one pixel (42.3 μm) at the on-axis image height is given as T3, and luminance at this time is given as P3. Also, in FIGS. 7A and 7B, the partial magnification at the maximum image height is 35 percent. Therefore, the scanning time of one pixel at the maximum image height is 0.74T3. In Japanese Patent Laid-Open No. 58-125064. the partial magnification is 35 percent, and thus the light-emitting time at the maximum image height is given as 0.74T3, which is equal to the scanning time of one pixel. In the present embodiment, unlike Japanese Patent Laid-Open No. 58-125064. the light-emitting time is not corrected based on the partial magnification, and light emission is performed for a shorter time than the scanning time of one pixel, except when Y=0. Also, rather than correcting luminance based on the partial magnification, luminance is corrected based on the light-emitting time, except when Y=0. In other words, light emission is performed at a greater luminance than the luminance according to Japanese Patent Laid-Open No. 58-125064, which is obtained by multiplying the luminance at Y=0 by the partial magnification. For example, in FIG. 7B, light emission at the maximum image height is performed for 0.22T3 which is shorter than the 1-pixel scanning time 0.74T3. Accordingly, luminance at the maximum image height is given as 1/0.22. that is, 4.50P3, at the on-axis image height. According to this configuration, as shown in FIG. 7B, differences in the shape of the 1-pixel LSF profiles due to differences in the main scanning direction position are reduced. Thus, in the present embodiment, light-emitting time correction is performed along with partial magnification correction, and luminance correction that incorporates light-emitting time correction is additionally performed. Hereinafter, the above configuration will be described in detail.

Figure 8:
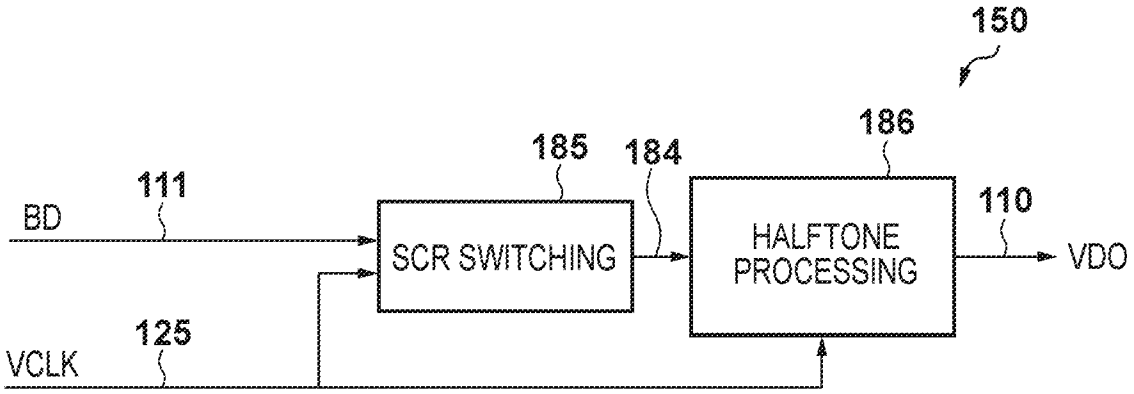
FIG. 8 is a block diagram showing a configuration of an image modulation unit according to one embodiment.
Figure 9:
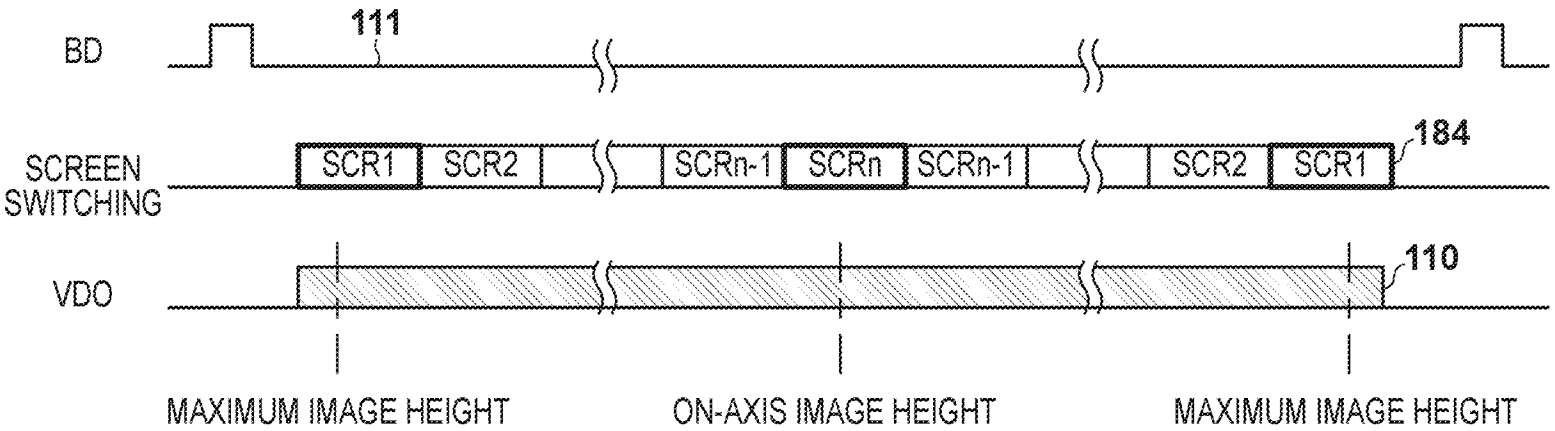
FIG. 9 is a timing chart of a synchronization signal, screen switching information and an image signal according to one embodiment.

FIG. 8 is a configuration diagram of an image modulation unit 150 of the image signal generation unit 100. A halftone processing unit 186 performs light-emitting time correction. The halftone processing unit 186 holds screens corresponding to the respective image heights, and performs halftone processing after selecting a screen to be used, based on screen switching information 184 that is output by a SCR switching unit 185. The SCR switching unit 185 generates the screen switching information 184 using the BD signal 111 and an image clock signal 125, which are synchronization signals. FIG. 9 shows the relationship between the BD signal 111 and the screen switching information 184. In the present embodiment, a scan line is divided into n regions according to the absolute values of the image heights, and a screen corresponding to each region is held in the halftone processing unit 186. Note that the regions are respectively given as regions 1 to n, the screen corresponding to the region that includes the on-axis image height is given as SCRn, and the screen corresponding to the region that includes the maximum image height is denoted as SCR1. Also, the screens SCR2 to SCRn-1 are used in regions other than the region including the maximum image height and the region including the on-axis image height, in order of closeness to the region including the maximum image height. The SCR switching unit 185 determines the scan region for development using the image clock signal 125, on the basis of the timing of the BD signal 111, and generates the screen switching information 184.

Figure 10A:
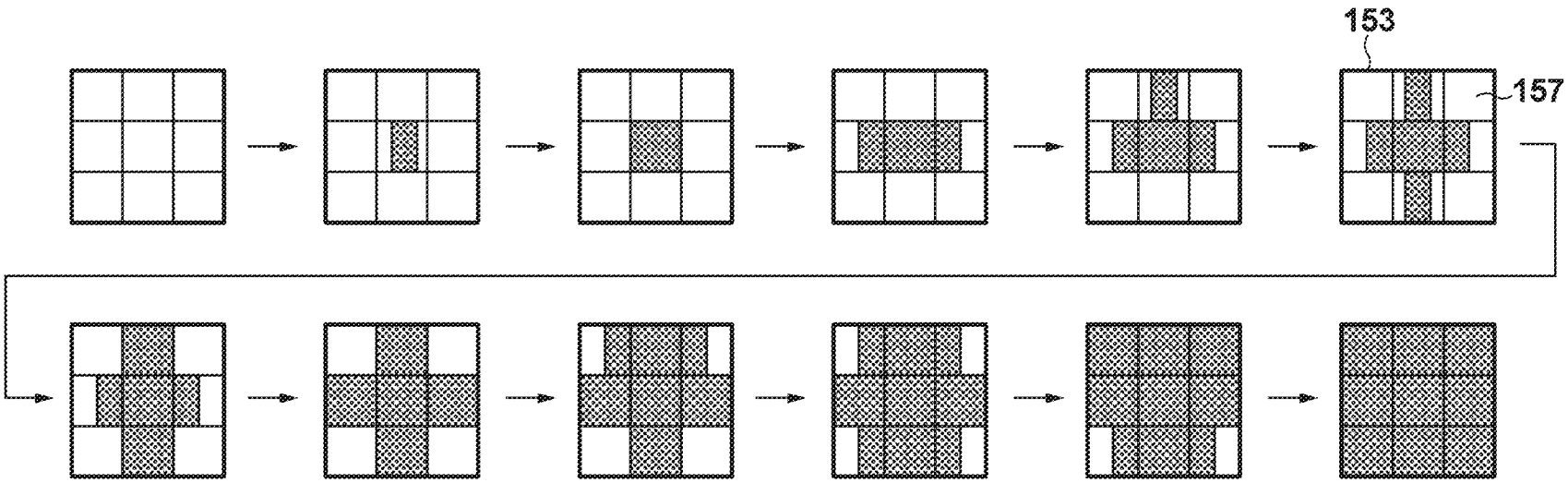
FIG. 10A is a diagram showing a screen that is used near an on-axis image height according to one embodiment.
Figure 10B:
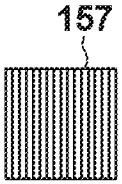
FIG. 10B is a diagram showing a pixel and pixel pieces according to one embodiment.
Figure 11:
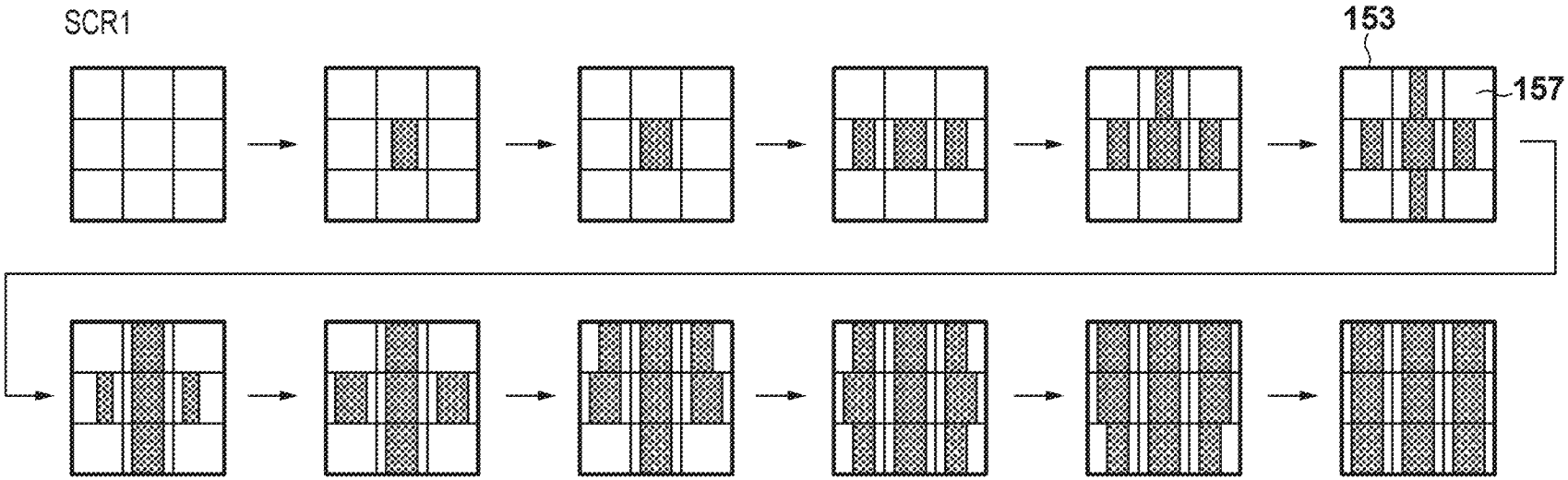
FIG. 11 is a diagram showing a screen that is used near a maximum image height according to one embodiment.

FIG. 10A shows an example of SCRn which is used in the range including the on-axis image height, and FIG. 11 shows an example of SCR1 which is used in the range including the maximum image height. As representatively shown in FIGS. 10A to 11, SCRk (k=1 to n) is assumed to be a 200-line matrix, and performs gradation expression with 16 pixel pieces obtained by dividing each pixel into 16. The area of a screen constituted by 9 pixels is changed, according to density information represented by the multi-value parallel 8-bit data of the VDO signal 110. A matrix 153 is provided every gradation, and the gradation increases (density increases) in the order shown by the arrows in FIGS. 10A and 11. As shown in FIG. 11, SRC1 is set such that not all of the pixel pieces of the 16 sections of each pixel are lighted, even in the matrix with the highest gradation (maximum density).

As an example, the case where the light-emitting time at the maximum image height is set to 0.22T3, as shown in FIG. 7B, will be described. As a result of executing partial magnification correction, the scanning time equivalent to 1 dot (pixel) will be 0.74T3. To restrict the maximum light-emitting time to 0.22T3, settings thus need only be configured such that light emission is performed within sections equivalent to 0.22/0.74 of the 16 sections of one pixel; that is:

$$16\times(0.22/0.74)=4.75 \text{ [section]}$$

Therefore, SRC1 need only be set such that the pixel pieces of a maximum of approximately five sections are lighted.

Next, luminance correction will be described. As a result of light-emitting time correction which has already been described, the light-emitting time of one pixel decreases as the absolute value of the image height Y increases. Accordingly, when luminance is fixed, the total light exposure amount (integrated light amount) of one pixel decreases as the absolute value of the image height Y increases. In the present embodiment, luminance correction for compensating for the decrease in this total light exposure is performed. In other words, the luminance of the light source 401 is corrected such that the total light exposure (integrated light amount) of one pixel is constant at each image height.

As shown in FIG. 4, the control unit 1 has an IC 3 that incorporates a CPU core 2, an 8-bit DA converter (DAC) 21 and a regulator (REG) 22, and constitutes a luminance correction unit together with the drive unit 300. The drive unit 300 has a memory 304, a VI conversion circuit 306 that converts voltage into current and a driver IC 9, and supplies drive current to the light-emitting unit 11 of the light source 401. Partial magnification characteristic information, light-emitting time characteristic information and the information on the correction current that is supplied to the light-emitting unit 11 are saved in the memory 304. The partial magnification characteristic information is information indicating partial magnification with respect to image height. Note that the partial magnification information need not be information indicating partial magnification directly. For example, the partial magnification information can be information that enables partial magnification with respect to image height to be derived, such as information indicating scanning speed with respect to image height. The light-emitting time characteristic information is light-emitting time information with respect to image height.

The IC 3 of the control unit 1 adjusts a voltage 23 that is output from the regulator 22, on the basis of information on the correction current to the light-emitting unit 11 acquired from the memory 304 by serial communication 307, and outputs the adjusted voltage. The voltage 23 serves as a reference voltage of the DA converter 21. Next, the IC 3 sets input data 20 of the DA converter 21, and outputs a luminance correction analog voltage 312 that changes according to image height in one scan line, in synchronization with the BD signal 111. This luminance correction analog voltage 312 is converted into a current value by the VI conversion circuit 306, and output to the driver IC 9. Note that although, in the present embodiment, the IC 3 mounted in the control unit 1 outputs the luminance correction analog voltage 312, a DA converter may be mounted on the drive unit 300 and the luminance correction analog voltage 312 may be generated in proximity to the driver IC 9.

The driver IC 9 performs ON/OFF control of light emitted from the light source 401, by switching a current IL between flowing to the light-emitting unit 11 and flowing to a dummy resistor 10 with the switch 14, according to the VDO signal 110. The drive current value IL that is supplied to the light-emitting unit 11 is a current obtained by subtracting a current Id that is output from the VI conversion circuit 306 from a current Ia set by a constant current circuit 15. The current Ia that flows in the constant current circuit 15 is feedback controlled and automatically adjusted by a circuit inside the driver IC 9, such that luminance that is detected by a photodetector 12 provided in the light source 401 for monitoring the light amount of the light-emitting unit 11 is a predetermined value Papc1. This automatic adjustment is so-called APC (Automatic Power Control). Automatic adjustment of the luminance of the light-emitting unit 11 is implemented at the timing at which the light-emitting unit 11 is being caused to emit light in order to detect the BD signal 111. The method of setting the current value Id that is output by the VI conversion circuit 306 will be discussed later. A variable resistor 13 adjusts a value so as to be input to the driver IC 9 as a desired voltage, in the case where the light-emitting unit 11 is emitting light at a predetermined luminance at the time of assembly.

As described above, a configuration is adopted in which a current obtained by subtracting the current value Id that is output by the VI conversion circuit 306 from the current Ia required in order to perform light emission at a predetermined luminance is supplied to the light-emitting unit 11 as the drive current IL. This configuration ensures that the drive current IL is less than the current Ia. Note that the VI conversion circuit 306 constitutes a part of the luminance correction unit.

Figure 12:
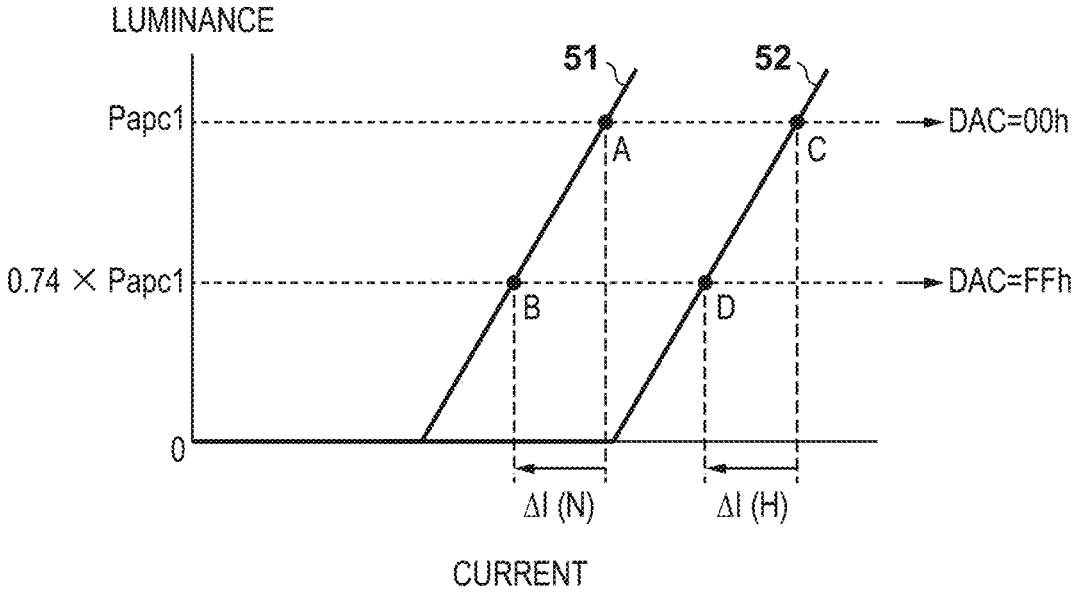
FIG. 12 is a diagram showing the relationship between current and luminance of a light-emitting unit according to one embodiment.

FIG. 12 is a graph showing current and luminance characteristics of the light-emitting unit 11. The current Ia required in order for the light-emitting unit 11 to emit light at a predetermined luminance changes depending on the ambient temperature. A graph 51 in FIG. 12 is an example of a graph in a normal temperature environment, and a graph 52 is an example of a graph in a high temperature environment. Generally, with the light-emitting unit 11 of a laser diode or the like, it is known that the current Ia required in order to output a predetermined luminance changes in the case where the environmental temperature changes, although there is little change in efficiency (slope in diagram). In other words, to perform light emission at a predetermined luminance Papc1, the current value shown with point A is required as the current Ia in a normal temperature environment, whereas the current value shown with point C is required in a high temperature environment. As aforementioned, even when the environmental temperature changes, the driver IC 9 automatically adjusts the current Ia that is supplied to the light-emitting unit 11 so as to achieve the predetermined luminance Papc1 by monitoring luminance with the photodetector 12. Since efficiency remains substantially unchanged even when environmental temperature changes, subtracting a predetermined current ΔI(N) or ΔI(H) from the current Ia for performing light emission at the predetermined luminance Papc1 enables luminance to be reduced to 0.74 times Papc1. Note that since efficiency remains substantially unchanged even when environmental temperature changes, ΔI(N) and ΔI(H) are the substantially the same. In the present embodiment, the luminance of the light-emitting unit 11 is gradually increased from the on-axis image height toward the maximum image height, and thus light emission is performed at the luminance shown with point B or point D in FIG. 12 at the on-axis image height, and is performed at the luminance shown with point A or point C at the maximum image height.

Luminance correction is performed by subtracting the current Id corresponding to the current ΔI(N) or ΔI(H) according to the image height from the automatically adjusted current Ia so as to perform light emission at a desired luminance. As mentioned above, the scanning speed increases as the absolute value of the image height Y increases. Also, the total light exposure amount (integrated light amount) of one pixel decreases as the absolute value of the image height Y increases. In the luminance correction, correction is performed such that the luminance increases as the absolute value of the image height Y increases. Specifically, the current IL is increased as the absolute value of the image height Y increases, by setting the current value Id to decrease as the absolute value of the image height Y increases. This enables the partial magnification to be appropriately corrected.

As described above, in the present embodiment, the scanning speed of the light spot that exposes the pixels of the photosensitive member 4 changes within a scan line. More specifically, the scanning speed of the light spot increases when the absolute value of the image height increases. As described using the exposure control configuration of FIG. 4, the luminance and the light-emitting time of the light source 401 are thus controlled, according to the pixels to be exposed. Specifically, the image modulation unit 150 holds a screen for controlling light-emitting time. Also, the control unit 1 controls the luminance of the light source 401 using information relating to the value of the correction current that is held in the memory 304. This screen is information indicating the light-emitting time on pixels, and the value of correction current is information indicating the luminance of pixels, with this information being collectively called scanning information. The image forming apparatus uses this scanning information to control the luminance and the light-emitting time of the light source with respect to pixels to be exposed.

Note that when the light-emitting time of a pixel is defined, as described using FIG. 7B, the luminance of that pixel can be determined from the light-emitting time and the luminance of the pixel at the on-axis image height. Hereinafter, the light-emitting time and the luminance for the pixel at the on-axis image height are respectively called a reference light-emitting time and a reference luminance, and the pixel at the on-axis image height is called a reference pixel. The reference pixel may be the pixel in the middle of the scan line or the pixel having the longest scanning time. As shown in FIG. 7B, the luminance for a pixel can be derived from the ratio of the light-emitting time of that pixel to the reference light-emitting time, and from the reference light-emitting time. Even in the case where the luminance of a pixel is defined rather than the light-emitting time, the light-emitting time of the pixel can be similarly derived. Accordingly, a configuration may be adopted in which only one of the luminance and the light-emitting time of the light source with respect to a pixel to be exposed is included as scanning information. Also, as shown in FIG. 7B, the light-emitting time of a reference pixel is equal to the scanning time of the reference pixel. In contrast, as shown in FIG. 7B, the light-emitting time of pixels that are not a reference pixel is shorter than the scanning time of those pixels. For example, in FIG. 7B, the scanning time of the pixel at the maximum image height is 0.74T3, whereas the light-emitting time is 0.22T3.

As described above, by controlling the light-emitting time and the luminance, accurate exposure in which distortion is suppressed can be performed without using a scanning lens having f-θ characteristics. Note that in the exposure control configuration shown in FIG. 4, control of light-emitting time and luminance is executed through the cooperation of the image signal generation unit 100, the control unit 1 and the drive unit 300. However, the present invention is not limited to such an embodiment, and a configuration can, for example, be adopted in which control of light-emitting time and luminance is performed by only one control unit or through the cooperation of an arbitrary number of functional blocks.

Correction control of light-emitting time and luminance based on the characteristics of the optical scanning apparatus 400 alone was described above. However, the positional relationship between the optical scanning apparatus 400 and the photosensitive member 4, which is the scan surface, could possibly shift from an ideal relationship, due to variation in the attachment position when mounting the optical scanning apparatus 400 to the image forming apparatus. As a result, the scan characteristic at the surface of the photosensitive member 4 changes. Even when the above-mentioned correction is performed, it is not impossible to appropriately correct the profile of the light spot, based on the characteristics of the optical scanning apparatus 400 alone.

Figure 13A:
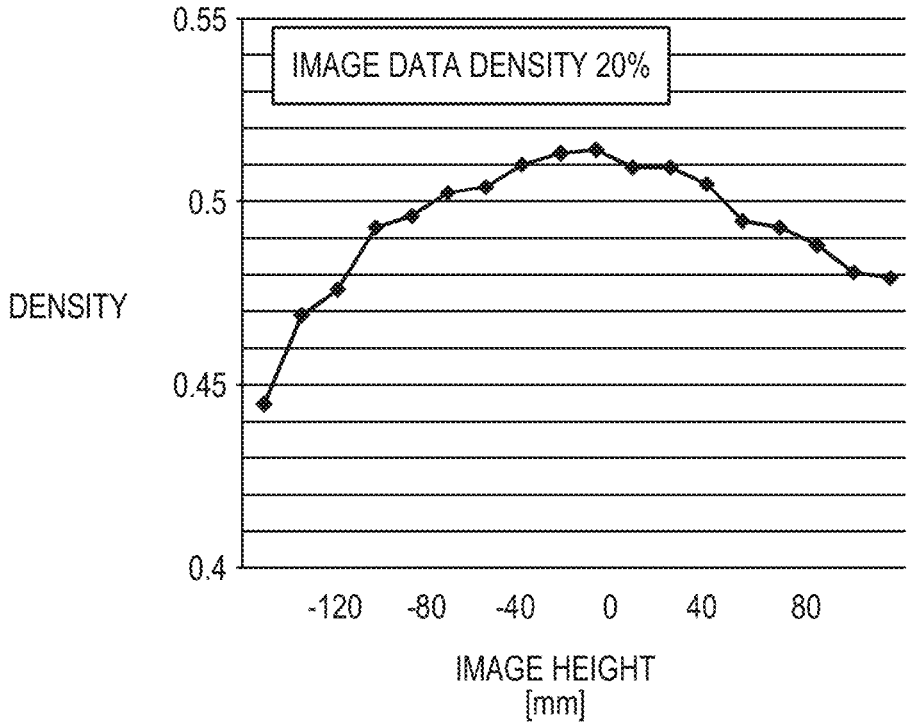
FIGS. 13A and 13B are diagrams showing the relationship between image height and density according to one embodiment.
Figure 13B:
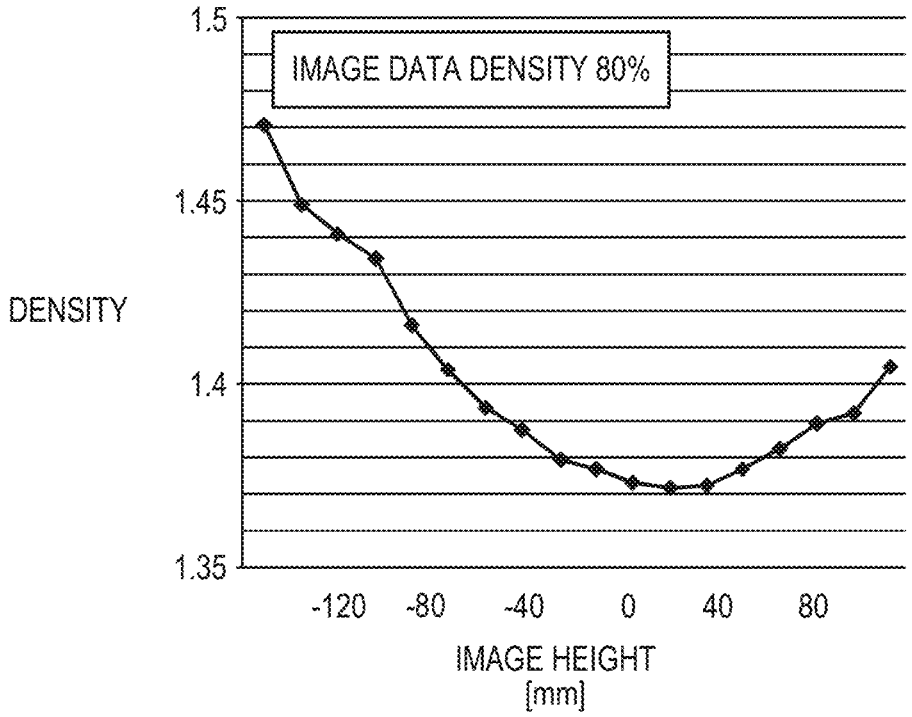

FIGS. 13A and 13B are graphs showing examples of the density measurement values of halftone images formed in a state where the profile of the spot is not uniform in the main scanning direction. FIG. 13A shows the characteristics when the halftone image is formed with image data corresponding to a density of 20 percent, with the density decreasing when the absolute value of the image height increases. On the other hand, FIG. 13B shows the characteristics when the halftone image is formed with image data corresponding to a density of 80 percent, with the density increasing when the absolute value of the image height increases. When the profile of the light spot cannot be appropriately corrected, the change in density can thus increase as the absolute value of the image height increases. Accordingly, the positional variation that occurs when the optical scanning apparatus 400 is mounted to the image forming apparatus needs to be corrected for positional shift. In the present embodiment, the profile of the light spot is appropriately corrected using the sensor 30.

Figure 14:
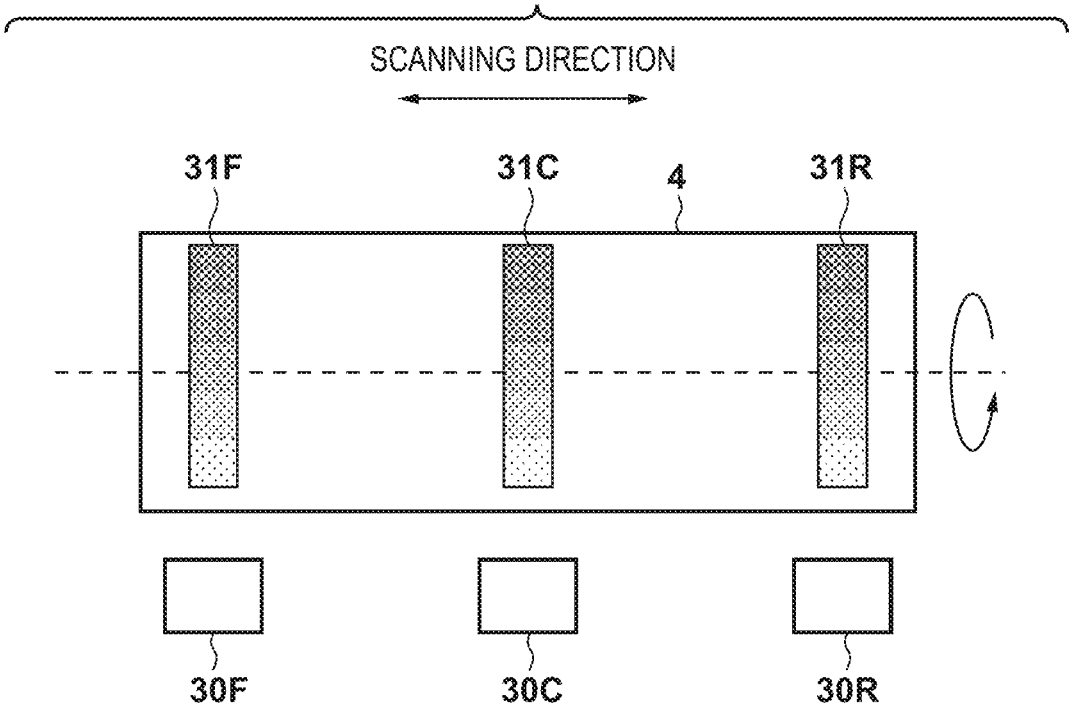
FIG. 14 is a configuration diagram of a density detection sensor according to one embodiment.

FIG. 14 is a diagram illustrating density detection according to the present embodiment. Three sensors 30F, 30C and 30R are disposed in the main scanning direction of the photosensitive member 4. The sensors 30 are specular reflective sensors provided with a light-receiving element and a light-emitting element such as a light-emitting diode (LED). The sensors 30 irradiate a patch 31 which is a developer image for use in density detection formed on the photosensitive member 4, with light from the light-emitting element, and reflected light is received by the light-receiving element. Since the light reflected by a toner part of the patch 31 is scattered, the reflected light that is received by the light-receiving element is light that was specularly reflected by the surface of the photosensitive member 4. Accordingly, the density of the patch 31 can be measured from the amount of light received by the sensors 30.

Also, in the present embodiment, the sensor 30C is disposed at the on-axis image height, and the sensors 30F and 30R are disposed near the maximum image height. This is to inhibit the profile of the light spot from shifting, even when the scanning speed at the on-axis image height is stable and the position of the optical scanning apparatus 400 shifts slightly. In other words, because a change in density does not readily occur at the on-axis image height, a change in density near the maximum image height where change readily occurs can be measured using the sensors 30F and 30R, on the basis of the measurement values of the sensor 30C.

Note that although the number of sensors 30 was given as three in the present embodiment, the present invention is not limited thereto. For example, if three or more sensors 30 are disposed, a change in density spanning the entire main scanning direction can be detected more accurately. Also, since the profile of the scanning speed basically has symmetry, it is also possible to reduce the sensors disposed near the maximum image height to one. For example, a configuration may be adopted in which two sensors 30C and 30F are provided. Also, although, in the present embodiment, a configuration is adopted in which a patch formed on the photosensitive member 4 is measured, a configuration may be adopted, in the case of an image forming apparatus equipped with an intermediate transfer body (not shown), in which a patch transferred from the photosensitive member 4 to the intermediate transfer body is measured. Patches 31F, 31C and 31R are formed so as to correspond to the respective sensors 30. Also, the patches 31 are assumed to be gradation patches that are contiguous from low density to high density, respectively.

Figure 15:
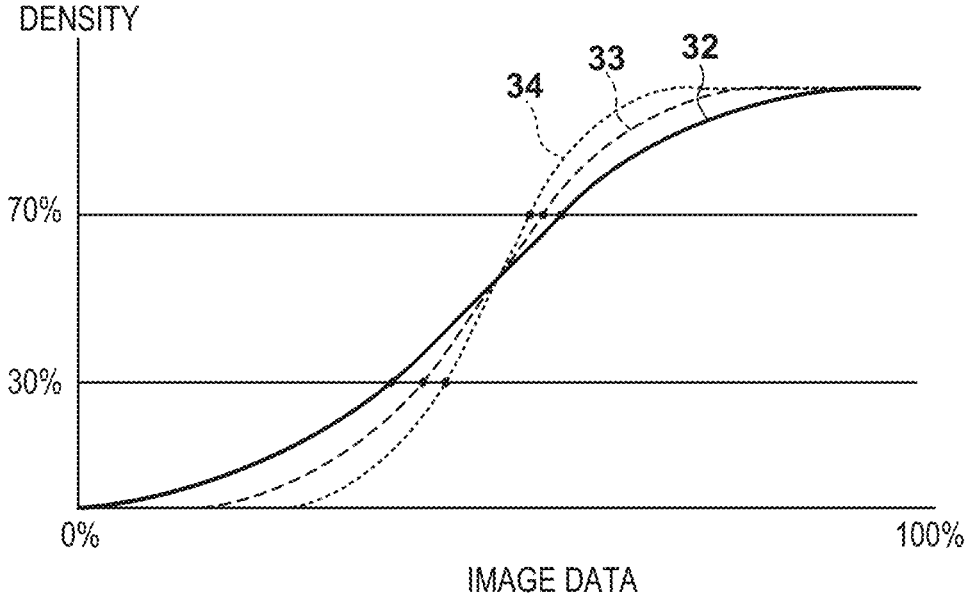
FIG. 15 is a diagram showing the relationship between image data and density according to one embodiment.

FIG. 15 is an example showing the results of detection performed on the patches 31 with the sensors 30. Note that a graph 32 is the detection result of the sensor 30C, a graph 33 is the detection result of the sensor 30F, and a graph 34 is the detection result of the sensor 30R. As clearly shown from the relationship between image height and density in FIGS. 13A and 13B, the graphs 33 and 34 of the sensors 30F and 30R exhibit a steep gradation density characteristic, as compared with the graph 32 of the sensor 30C.

Figure 16:
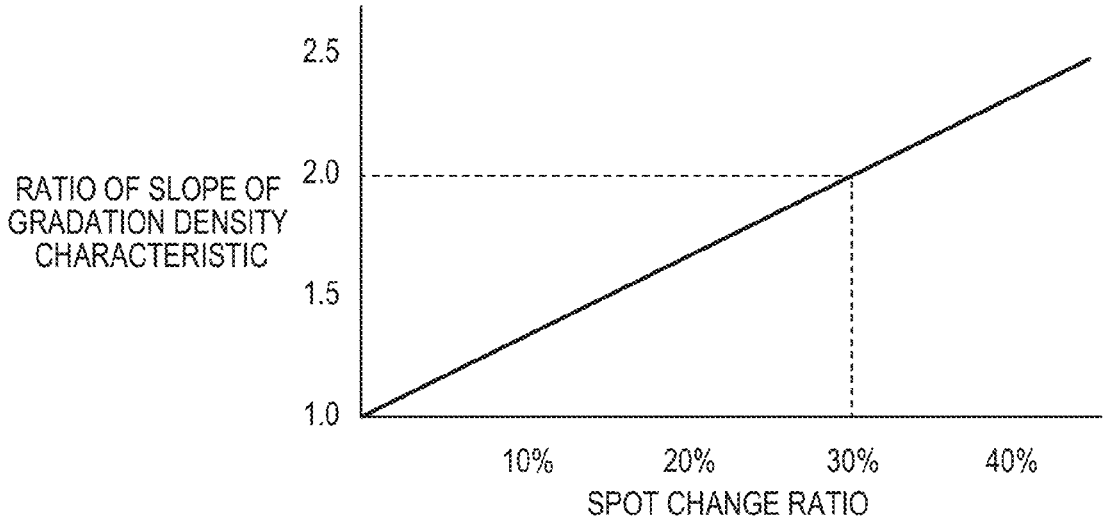
FIG. 16 is a diagram showing the relationship between a change ratio of spot diameter and a ratio of the slope of a gradation density characteristic.

Next, a method of correcting the profile of a light spot will be described. As shown in FIG. 1, the sensor 30 is connected to the image signal generation unit 100. The image signal generation unit 100 derives the change in the profile of the light spot by acquiring the gradation density characteristic measured with the sensor 30C as a reference, and comparing the acquired gradation density characteristic with the gradation density characteristics measured with the sensors 30F and 30R. In the present embodiment, as shown in FIG. 15, the slope of the gradation density characteristic in the section where density is 30 to 70 percent of density is used. The image signal generation unit 100 uses the slope measured by the sensor 30C as the reference value to calculate the ratio of the reference value and the slope measured by the sensors 30F and 30R. Also, the memory 304 of the drive unit 300 saves a table that is not illustrated in which the calculated ratio is associated with a change ratio of the light spot. The image signal generation unit 100 corrects either one or both of the light-emitting time and luminance determined in the manner described above, based on the change ratio of the light spot corresponding to the calculated ratio. Note that as a method of deriving the change ratio of the light spot from the calculated ratio, a calculation equation that associates the calculated ratio with the change ratio of the spot may be used instead of a table. FIG. 16 shows an exemplary relationship between the calculated ratio of the slope of the gradation density characteristic and the change ratio of the light spot. Note that since the relationship shown as an example in FIG. 16 changes depending on the characteristics of the optical scanning apparatus 400 and the configuration of image forming apparatus, a unique table or calculation equation is derived in advance for every image forming apparatus. The relationship between the change ratio of the light spot and the correction value of light-emitting time or luminance is also derived in advance and saved to the memory 304. Note that a configuration may be adopted in which the relationship between the change ratio of the light spot and the correction value of light-emitting time or luminance is saved as a table or as a calculation equation.

Note that although, in the present embodiment, a plurality of gradation patches from low density to high density were formed as patches for density detection, the present invention is not limited thereto. Specifically, the pattern need only enable the change in density according to image height to be detected. For example, the slope may be derived from the detected density of two types of patches formed with the image data corresponding to a density of 30 percent and a density of 70 percent. Furthermore, although the change ratio of the light spot is derived using the ratio of the slope of the gradation density characteristic, the present invention is not limited to this configuration. In other words, any parameter that is correlated with the change in the light spot may be used, and a configuration may, for example, be adopted in which the detected densities of patches of specific image data are compared or in which a difference is used rather than a ratio.

As mentioned above, in the present embodiment, profile information indicating changes due to scanning position of the light spot, that is, the position of the pixel to be exposed is held. The profile information is, for example, the above-mentioned change ratio of the light spot according to the position of the pixel. Also, in determining the luminance and the light-emitting time of the light source with respect to a pixel, the image forming apparatus uses the above-mentioned scanning information and profile information. For example, either one or both of luminance and light-emitting time of the light source with respect to the pixel determined based on scanning information is corrected based on the profile information. Note that the control unit 1 forms the patches 31 for detecting density on the photosensitive member 4, and thereby detects changes in the density of each pixel in the main scanning direction and generates profile information. Specifically, the sensors 30F, 30C, and 30R are provided at a plurality of positions in the main scanning direction, and detect changes in the density of each pixel in the main scanning direction, based on the density detected by each sensor. Note that a configuration can, for example, be adopted in which sensors are provided at least in the middle and at an end part of a scan line. This configuration enables the profile of the light spot to be corrected, irrespective of any change in density due to a change in image height. As a result, it is possible to perform accurate exposure that suppressed distortion, without using a scanning lens having f-θ characteristics.

Second Embodiment

Next, a second embodiment will be described focusing on differences with the first embodiment. In the first embodiment, the change ratio of the light spot was derived from the density measurement result, with respect to a change in the light spot due to positional variation in the optical scanning apparatus 400, and light-emitting time and luminance were corrected. In the present embodiment, the light spot is directly measured after attaching the optical scanning apparatus 400 to an image forming apparatus. As the method of measuring the light spot, a spot measuring function of a common measuring device need only be used, for example. Even though there is an increase in costs compared with the configuration of the first embodiment since the task of measuring the spot arises with this method, measuring the spot directly enables the spot to be corrected more accurately. In the present embodiment, a measuring device 500 is used as a spot information detection unit.

Figure 17:
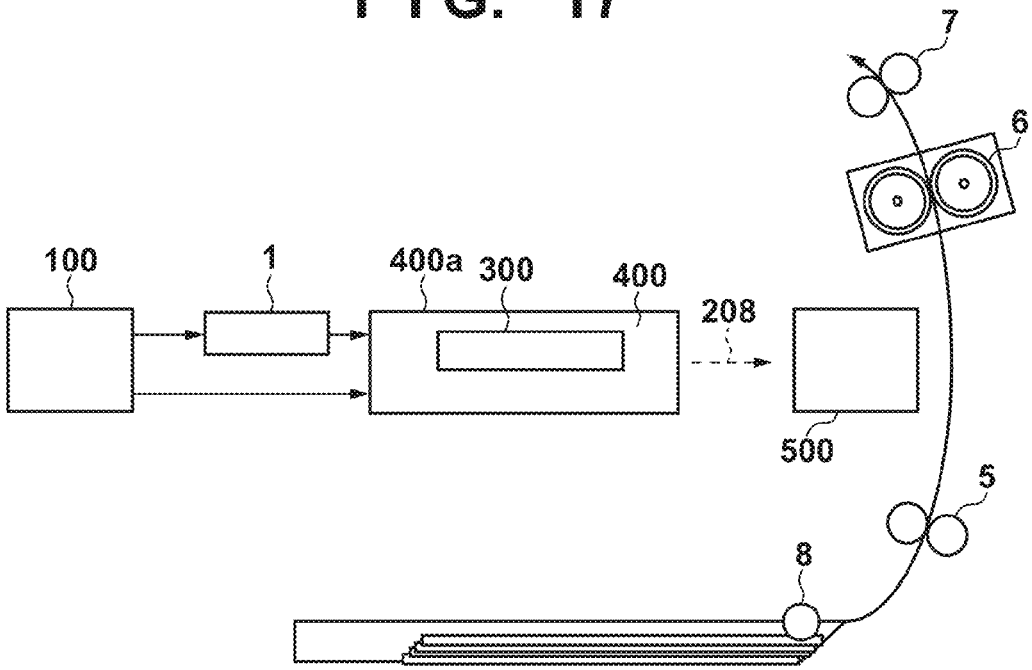
FIG. 17 is a schematic view of an image forming apparatus according to one embodiment.

FIG. 17 shows a configuration for measuring a light spot according to the present embodiment. The measuring device 500 for measuring the light spot is installed in a state where the photosensitive member 4 of FIG. 1 is detached, and measures the profile of the light spot of the light 208. At this time, the profile of the light spot on the surface of the photosensitive member 4 can be measured, by disposing the light-receiving surface of the measuring device 500 to coincide with the light-receiving surface of the photosensitive member 4.

Next, a method of correcting the profile of the light spot will be described. Profile information on the light spot measured by the measuring device 500 is written to the memory 304 of the drive unit 300. Also, a reference value of the light spot is held in the memory 304. The image signal generation unit 100 calculates the change ratio of the light spot to the image height, from the reference value of the profile of the light spot saved in the memory 304, and updates the correction value of light-emitting time and luminance, based on the calculated change ratio of the light spot. Note that the method of correcting light-emitting time and luminance is similar to the first embodiment, and description thereof has been omitted. Also, the measuring device 500 is detached after measuring the spot, and the photosensitive member 4 is mounted.

Note that if the image forming apparatus is not configured with a detachable photosensitive member 4, the profile of the light spot can also be measured by disposing the measuring device 500 between the optical scanning apparatus 400 and the photosensitive member 4, for example. Even though the light-receiving surface of the measuring device 500 does not coincide with the light-receiving surface of the photosensitive member 4 in the case of using this configuration, the light spot produced on the surface of the photosensitive member 4 can be derived from the measured light spot, based on the positional relationship therebetween and the optical characteristics of the lens.

According to the present embodiment, as described above, the profile of the light spot can be appropriately corrected even in the case where positional variation of the optical scanning apparatus 400 occurs, by directly measuring the profile of the light spot, after attaching the optical scanning apparatus 400 to the image forming apparatus. As a result, it is possible to perform accurate exposure in which distortion is suppressed, without using a scanning lens having f-θ characteristics.

Third Embodiment

Next, a third embodiment will be described focusing on differences with the first embodiment and the second embodiment. In the first embodiment and the second embodiment, the light spot was corrected for variation in the attachment position of the optical scanning apparatus 400. However, change in the light spot is also produced by factors other than variation in the attachment position. For example, the profile of the light spot may change as a result of the internal temperature of the image forming apparatus rising due to the influence of continuous printing or the like, causing thermal expansion of the imaging lens 406 and the like and changing the imaging characteristics. In the present embodiment, change in the profile of the light spot due to such changes in the environment of the image forming apparatus is also corrected. In the present embodiment, temperature is used as information indicating this environment, and, therefore, a temperature sensor 550 is provided as a temperature detection unit that measures the temperature inside the image forming apparatus.

Figure 18:
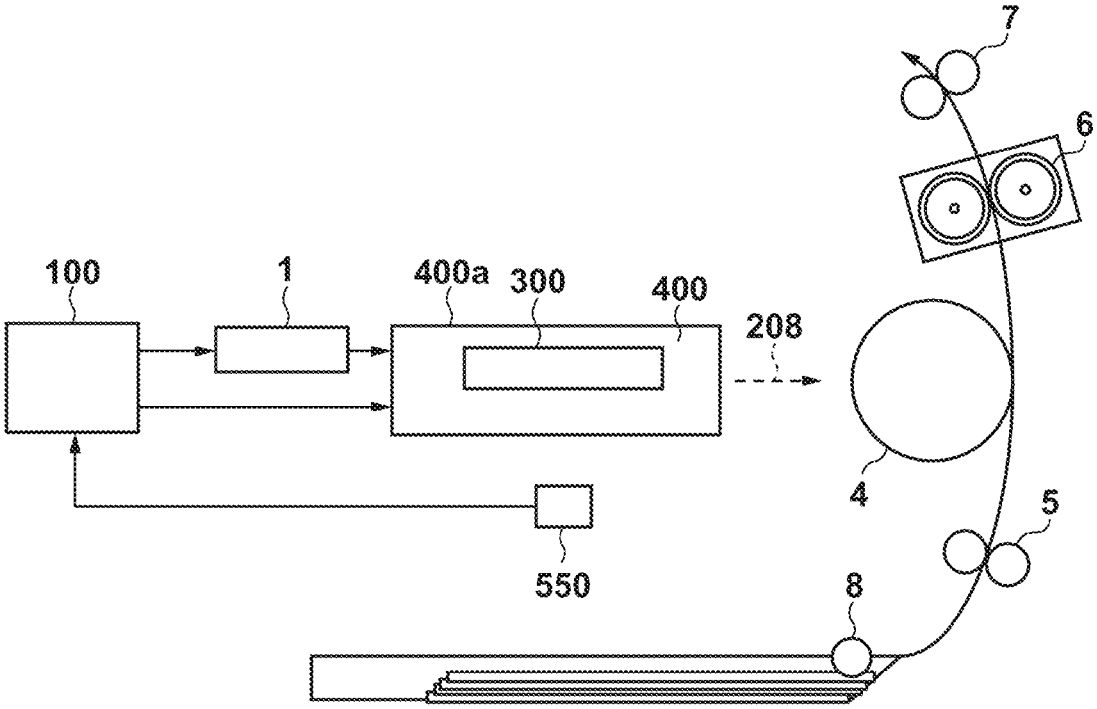
FIG. 18 is a schematic view of an image forming apparatus according to one embodiment.

FIG. 18 is a configuration diagram of the image forming apparatus according to the present embodiment. A difference from the first embodiment and the second embodiment lies in the disposition of the temperature sensor 550 on the periphery of the optical scanning apparatus 400. Also, the influence of the positional variation in the optical scanning apparatus 400 is corrected using the method according to the second embodiment. However, a configuration may also be adopted in which a sensor 30 is disposed for use in performing correction, similarly to the first embodiment.

The temperature sensor 550 is connected to the image signal generation unit 100, and transmits the measured temperature information to the image signal generation unit 100. The memory 304 of the drive unit 300 saves a table that is not illustrated showing the relationship between the temperature information measured by the temperature sensor 550 and the profile of the light spot on the photosensitive member 4. Because the thermal expansion and imaging characteristics of the imaging lens 406 are correlated, it is possible to create the table by taking the correlation between the ambient temperature of the optical scanning apparatus 400 and the profile of the light spot. Also, the memory 304 saves the reference value of the light spot.

Next, a method of correcting the profile of the light spot will be described. The image signal generation unit 100 derives the profile of the light spot based on the table, from the temperature information measured by the temperature sensor 550. Furthermore, the change ratio of the spot is calculated from the reference value saved in the memory 304. The profile of the spot can be appropriately corrected, by updating the correction values of light-emitting time and luminance, based on the calculated change ratio of the spot. The method of correcting light-emitting time and luminance is similar to the first embodiment, and the description thereof is omitted.

As described above, according to the present embodiment, it is possible to correct changes in the profile of the light spot due to mechanical influences that also include influences due to change of the environment in which the image forming apparatus is installed and change of operating state, in addition to positional variation of the optical scanning apparatus 400. As a result, it is possible to perform accurate exposure in which distortion is suppressed, without using a scanning lens having f-θ characteristics.

Fourth Embodiment

Figure 19:
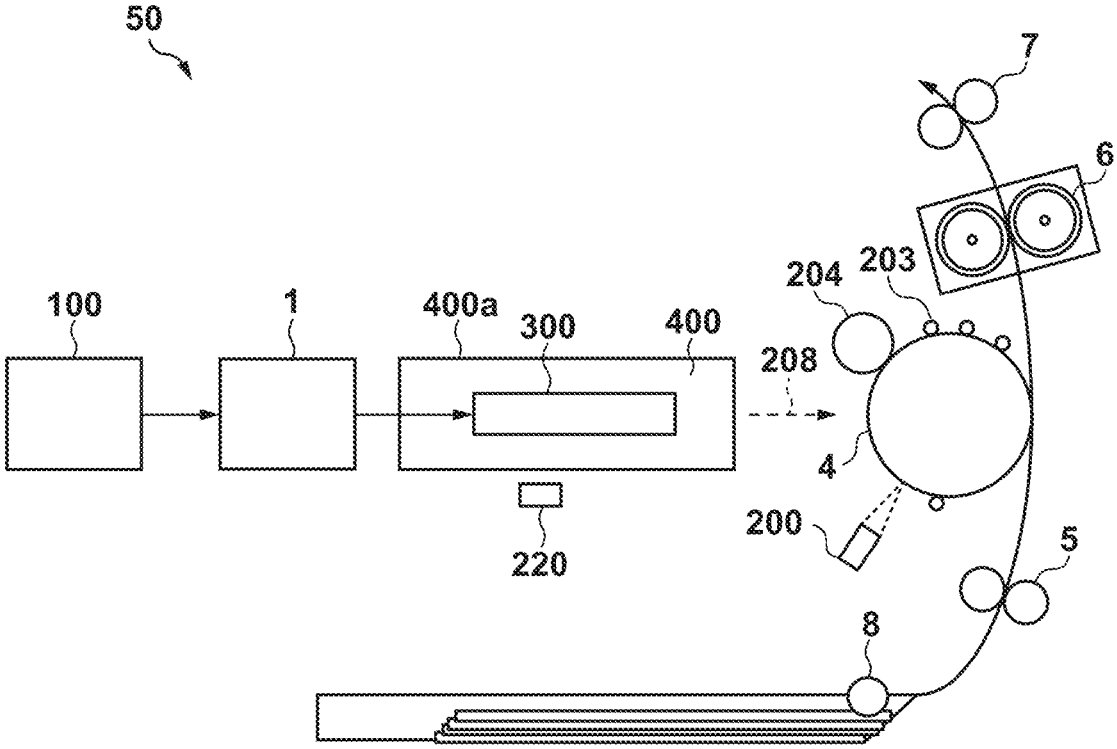
FIG. 19 is a schematic configuration diagram of an image forming apparatus according to one embodiment.

Next, the present embodiment will be description focusing on the differences with the first embodiment. FIG. 19 is a configuration diagram of an image forming apparatus 50 of the present embodiment. In FIG. 19, a developing device 204 causes toner to adhere to an electrostatic latent image on the photosensitive member 4, and forms a toner image (developer image). A sensor 200 is a toner mark detection unit (toner mark detection sensor) for detecting the existence of a toner mark 203. The toner mark will be discussed in detail later. Also, a temperature sensor 220 detects the temperature of the image forming apparatus.

Next, exposure control in the image forming apparatus 50 will be described, with reference to FIG. 4. In the present embodiment, partial magnification characteristic information on the optical scanning apparatus 400 is stored in the memory 304. The partial magnification characteristic information is partial magnification information corresponding to a plurality of image height in the main scanning direction. This partial magnification characteristic information may be measured and stored in the individual apparatuses after assembly of the optical scanning apparatus 400, or typical characteristics may be stored without individually measuring the various apparatuses in the case where there is little variation between the individual apparatuses. Note that the characteristic information on the scanning speed on the scan surface 407 may be used instead of partial magnification information. In other words, the partial magnification information serves as information for performing correction such that the spot of the laser beam irradiated onto the photosensitive member 4 moves at a uniform speed over the surface of the photosensitive member 4, even in the imaging lens 406 which does not have f-θ characteristics that is applied in the present embodiment.

The CPU core 2 reads out partial magnification characteristic information from the memory 304 via the serial communication 307, and transmits the read partial magnification characteristic information to the CPU that is in the image signal generation unit 100 via the serial communication 113. The CPU core 2 generates partial magnification correction information, based on the acquired partial magnification characteristic information, and sends the generated partial magnification correction information to a pixel piece insertion/extraction control unit 128 discussed later that is provided in the image modulation unit 150 of FIG. 4.

As mentioned above, the movement speed of light that is irradiated by the light source 401 differs according to the position in the main scanning direction. Accordingly, as shown in a toner image A of FIG. 5B, a latent image dot1 at the maximum image height having a fast scanning speed widens in the main scanning direction when compared with a latent image dot2 at the on-axis image height. Thus, in the present embodiment, as partial magnification correction, the cycle and time width of the VDO signal 110 are corrected according to the position in the main scanning direction. In other words, in the configuration applied in the present embodiment, the light-emitting time interval (scanning time) at the maximum image height is shortened as compared with the light-emitting time interval at the on-axis image height, by partial magnification correction, and, as shown in a toner image B, a latent image dot3 at the maximum image height and a latent image dot4 at the on-axis image height are configured to be an equivalent size. Such correction enables the latent images of dot shapes corresponding to pixels to be formed substantially equidistantly with regard to the main scanning direction, similarly to an f-θ lens.

Figure 20:
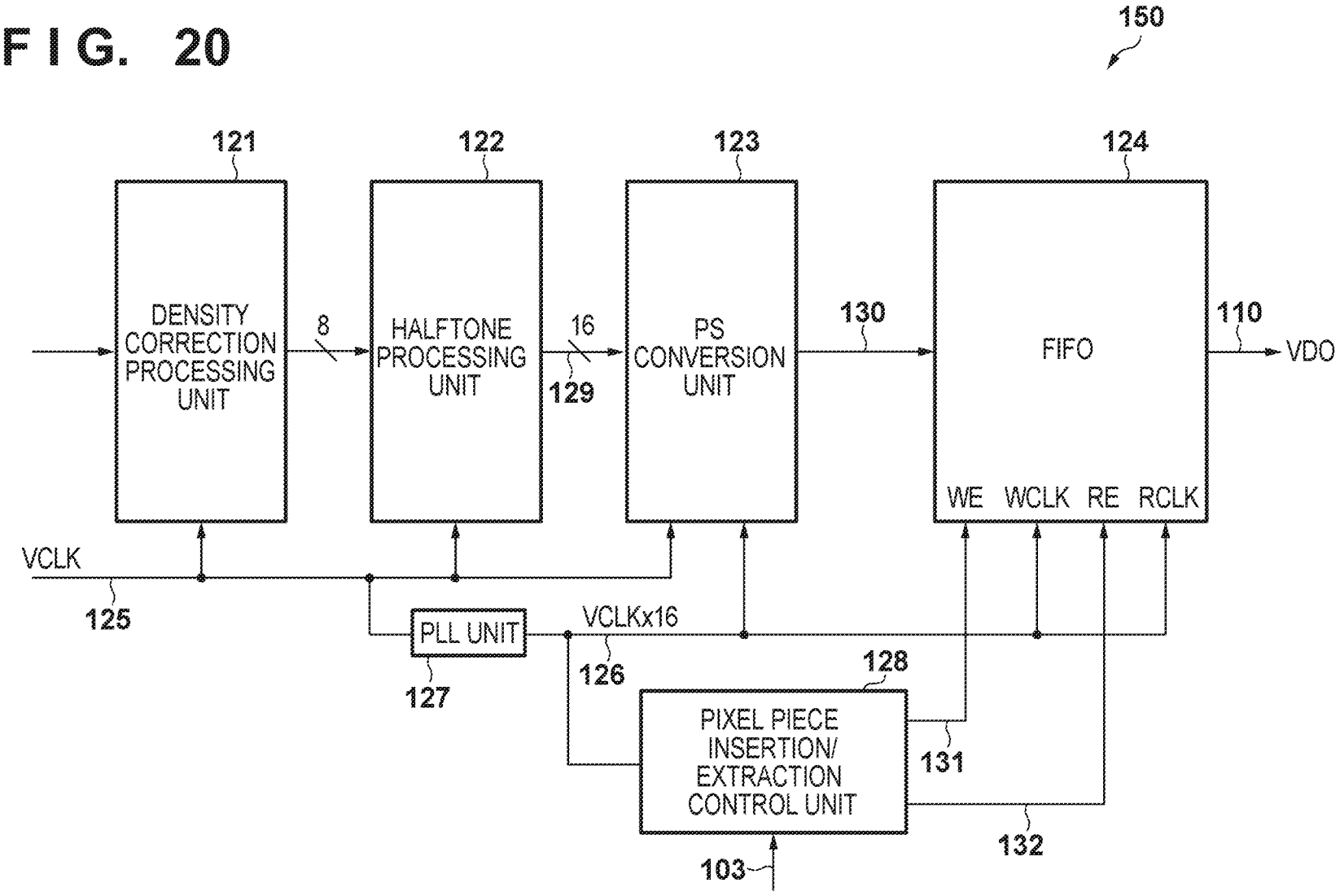
FIG. 20 is a block diagram of an image modulation unit according to one embodiment.

Next, specific control of partial magnification correction for shortening the irradiation time of the light source 401 by an amount equivalent to the increase in partial magnification as the position shifts from the on-axis image height to the maximum image height will be described, with reference to FIGS. 20 to 23. FIG. 20 shows an example of the control configuration of the image modulation unit 150. The image modulation unit 150 is provided with a density correction processing unit 121, a halftone processing unit 122, a PS conversion unit 123, a FIFO 124, a PLL unit 127, and a pixel piece insertion/extraction control unit 128.

The density correction processing unit 121 stores a density correction table for printing an image signal received from the host computer at an appropriate density. The halftone processing unit 122 performs conversion processing for density representation in the image forming apparatus by performing screen (dither) processing on parallel multi-value 8-bit image signals that are input. The operations of the PS conversion unit 123, the FIFO 124, the PLL unit 127, and the pixel piece insertion/extraction control unit 128 will be discussed later.

FIG. 10A shows an example of a screen. Density representation is performed in 200 matrixes 153 of 3 main-scan pixels and 3 sub-scan pixels. The white portions in the diagram are (OFF) portions where the light source 401 is not caused to emit light, and the shaded portions are (ON) portions where the light source 401 is caused to emit light. The matrix 153 is provided for every gradation, and gradation increases, that is, density increases, in the order shown by an arrow. In the present embodiment, one pixel 157 is a unit dividing the image data in order to form one dot of 600 dpi on the scan surface 407. As shown in FIG. 10B, in a state before correcting the pixel width, one pixel is constituted by 16 pixel pieces having a width of 1/16 of one pixel, and light-emission of the light source 401 is switched on and off every pixel piece. In other words, a 16-step gradation can be represented with one pixel.

The PS conversion unit 123 is a parallel-serial conversion unit, and converts a parallel 16-bit signal 129 input from the halftone processing unit 122 into a serial signal 130. The FIFO 124 receives the serial signal 130, stores the received serial signal in a line buffer, and, after a predetermined time has elapsed, outputs the buffered signal as the VDO signal 110 to the downstream laser drive unit 300, similarly as a serial signal. Control of writing to and reading from the FIFO 124 is performed by the pixel piece insertion/extraction control unit 128 controlling a write enable signal WE 131 and a read enable signal RE 132, in accordance with the partial magnification characteristic information that is received from the image signal generation unit 100 via the CPU bus 103. The PLL unit 127 supplies a clock (VCLK×16) 126 obtained by multiplying the frequency of the clock (VCLK) 125 equivalent to one pixel by 16 to PS conversion unit 123 and the FIFO 124.

Figure 21:
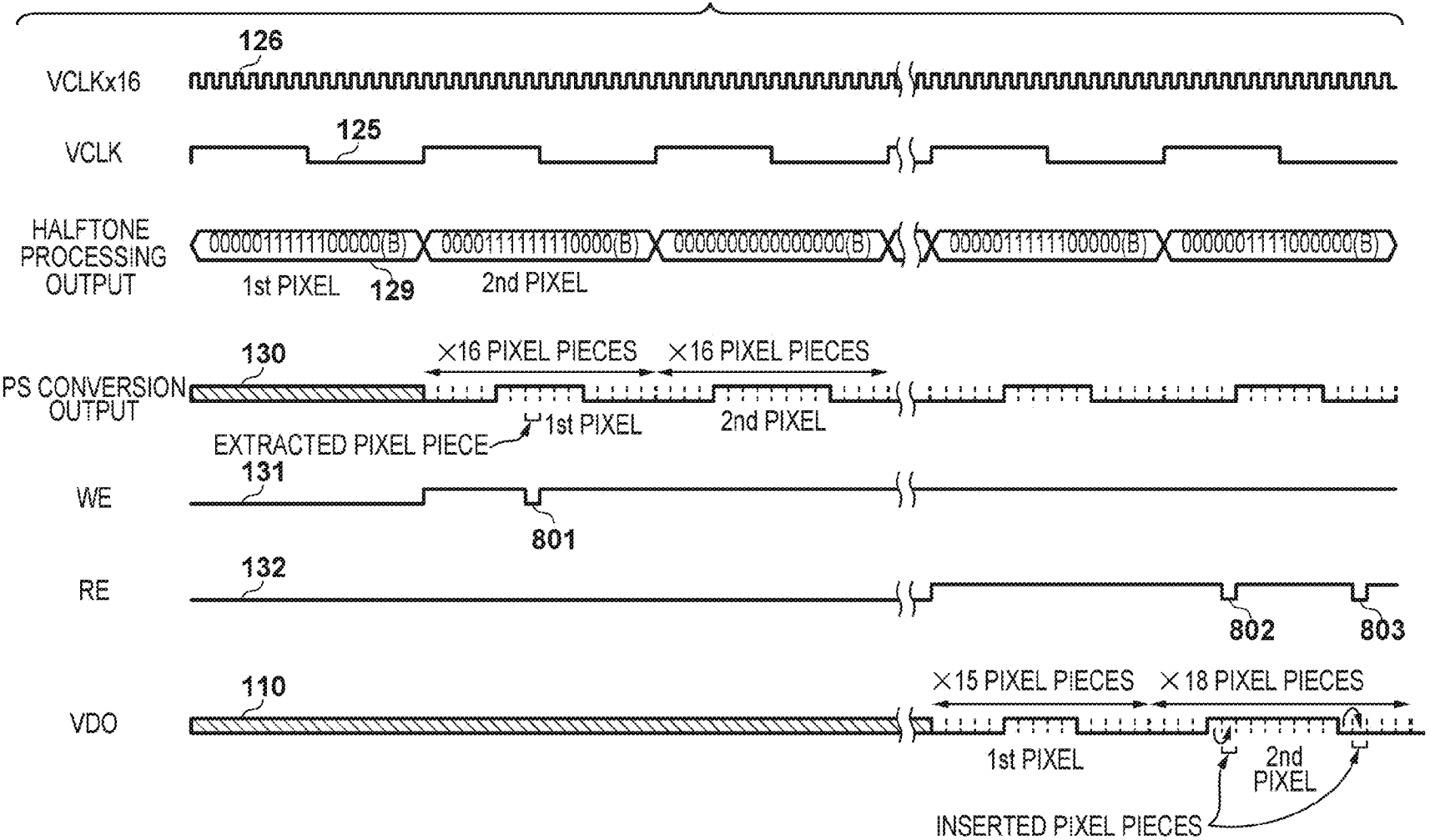
FIG. 21 is a timing chart relating to operations of an image modulation unit according to one embodiment.

Next, operations after halftone processing in the block diagram of FIG. 20 will be described using the timing chart of FIG. 21 relating to the operations of the image modulation unit 150. As mentioned above, the PS conversion unit 123 imports a multi-value 16-bit signal 129 from the halftone processing unit 122 in synchronization with the clock 125, and sends the serial signal 130 to the FIFO 124 in synchronization with the clock 126.

Figure 5B:
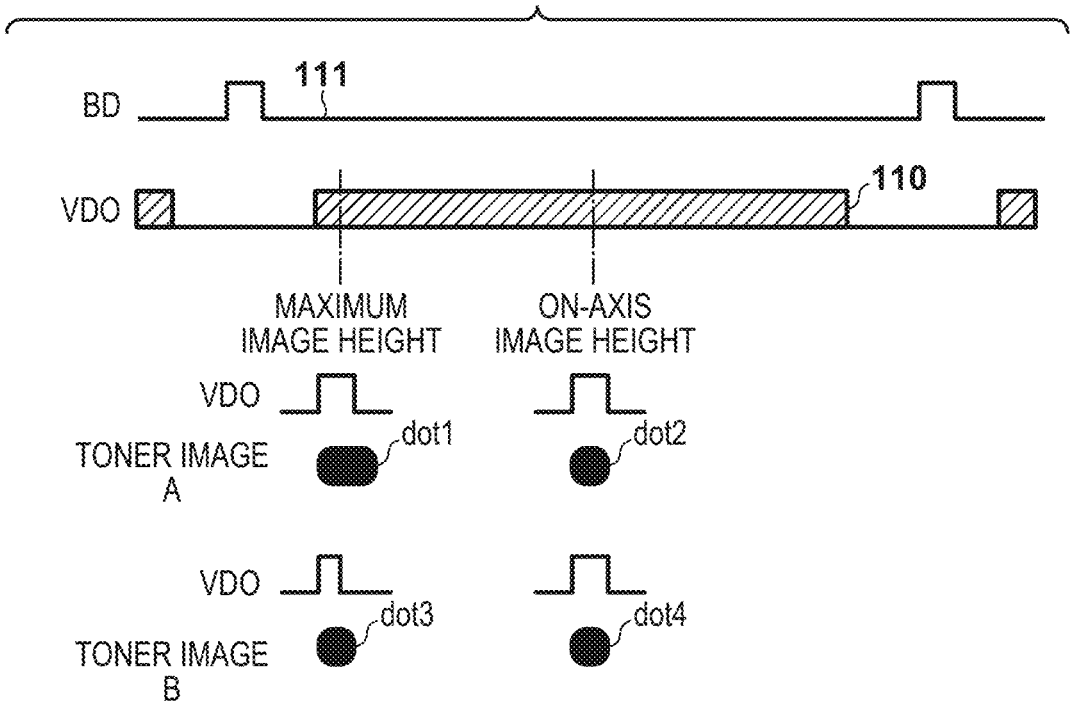

The FIFO 124 only imports the signal 130 from the PS conversion unit 123 in the case where the WE signal 131 from the pixel piece insertion/extraction control unit 128 is valid "HIGH". In the case of shortening an image in the main scanning direction in order to perform correction of partial magnification, the pixel piece insertion/extraction control unit 128 is able to perform control so as to not allow the FIFO 124 to import the serial signal 130, by setting the WE signal partially to invalid "LOW". FIG. 21 shows an example, in the case where one pixel is normally constituted by 16 pixel pieces, in which a first pixel is constituted by 15 pixel pieces after having one pixel piece extracted, as shown by 801. In other words, as shown in FIG. 5B, pixel pieces are extracted so as to make a latent image dod3 at the maximum image height and a latent image dod4 at the on-axis image height an equivalent size.

Also, the FIFO 124 only reads out stored data in the case where the RE signal 132 is valid "HIGH", in synchronization with the clock 126 (VCLK×16), and outputs the VDO signal 110 to the laser drive unit 300. In the case of lengthening an image in the main scanning direction in order to perform correction of partial magnification, the pixel piece insertion/extraction control unit 128, by setting the RE signal 132 partially to invalid "LOW", causes the FIFO 124 to continuously output data of the previous clock of the clock 126, without updating the readout data. In other words, pixel pieces of the same data as the data of pixel pieces that are adjacent on the upstream side in the main scanning direction processed immediately before will be inserted. FIG. 21 shows an example, in the case where one pixel is normally constituted by 16 pixel pieces, in which a second pixel is constituted by 18 pixel pieces after having two pixel pieces inserted, as shown by 802 and 803. According to the present embodiment, at an image height where the scanning speed is faster than at the on-axis image height, at least one pixel piece is thus extracted from the predetermined number of pixel pieces representing one pixel. On the other hand, at an image height where the scanning speed is slower than at the on-axis image height, at least one pixel piece is inserted into the predetermined number of pixel pieces representing one pixel. Note that the FIFO 124 used in the present embodiment was described as a circuit having a configuration that continuously outputs previous data, in the case where the RE signal is invalid "LOW", rather than output entering a Hi-Z state.

FIGS. 22A to 22C and FIGS. 23A and 23B are diagrams that use graphical images to illustrate signals from the parallel 16-bit signal 129, which is an input image of the halftone processing unit 122, to the VDO signal 110, which is the output of the FIFO 124.

Figure 22A:
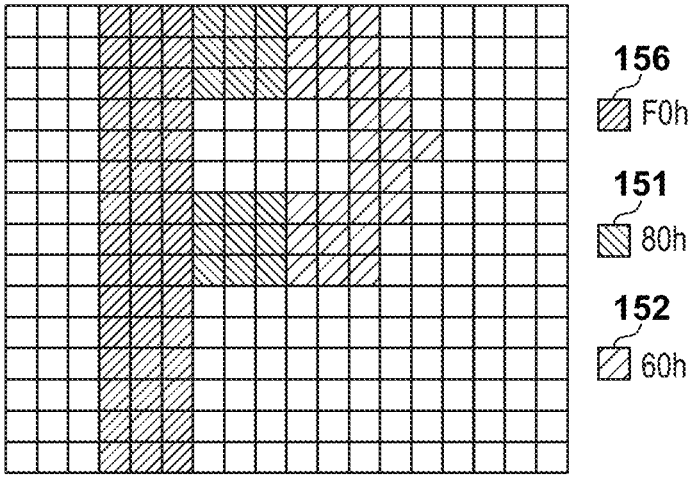
FIG. 22A is a diagram showing an example of an image signal that is input to a halftone processing unit.
Figure 22B:
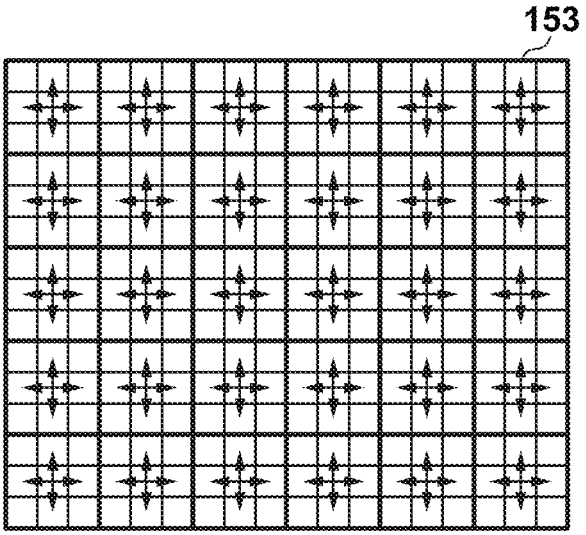
FIG. 22B is a diagram showing a screen according to one embodiment.
Figure 22C:
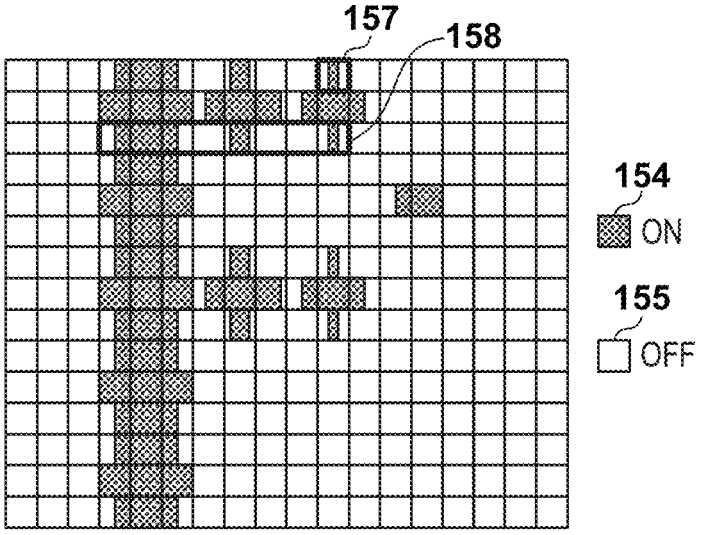
FIG. 22C is a diagram showing an example of an image signal after halftone processing.

FIG. 22A is an example of parallel multi-value 8-bit image signals that are input to the halftone processing unit 122. Each pixel has 8-bit density information. The density information of pixels 156, 151 and 152 and the white portion is respectively F0h, 80h, 60h and 00h. FIG. 22B is a screen, and, as described with FIG. 10A, the screen extends from the middle to 200 lines. FIG. 22C is an graphical image of an image signal which is a parallel 16-bit signal 129 after halftone processing, and each pixel 157 is constituted by 16 pixel pieces as mentioned above.

Figure 23A:
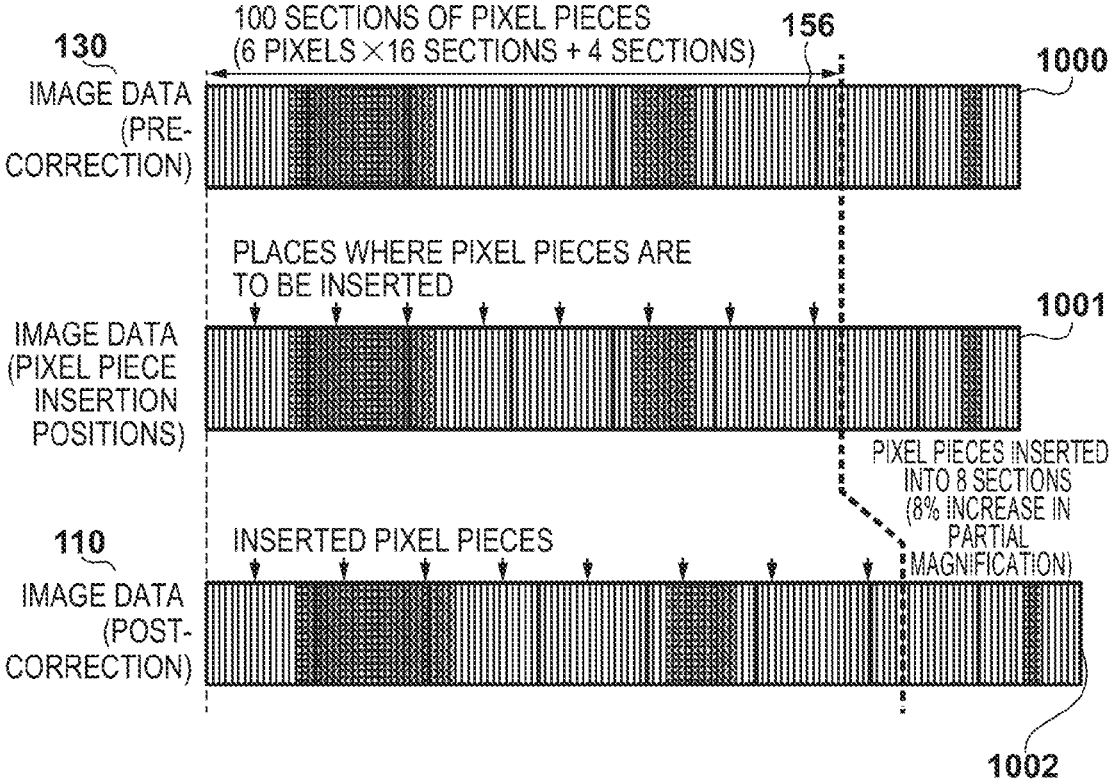
FIGS. 23A and 23B are diagrams illustrating insertion/extraction of pixel pieces.
Figure 23B:
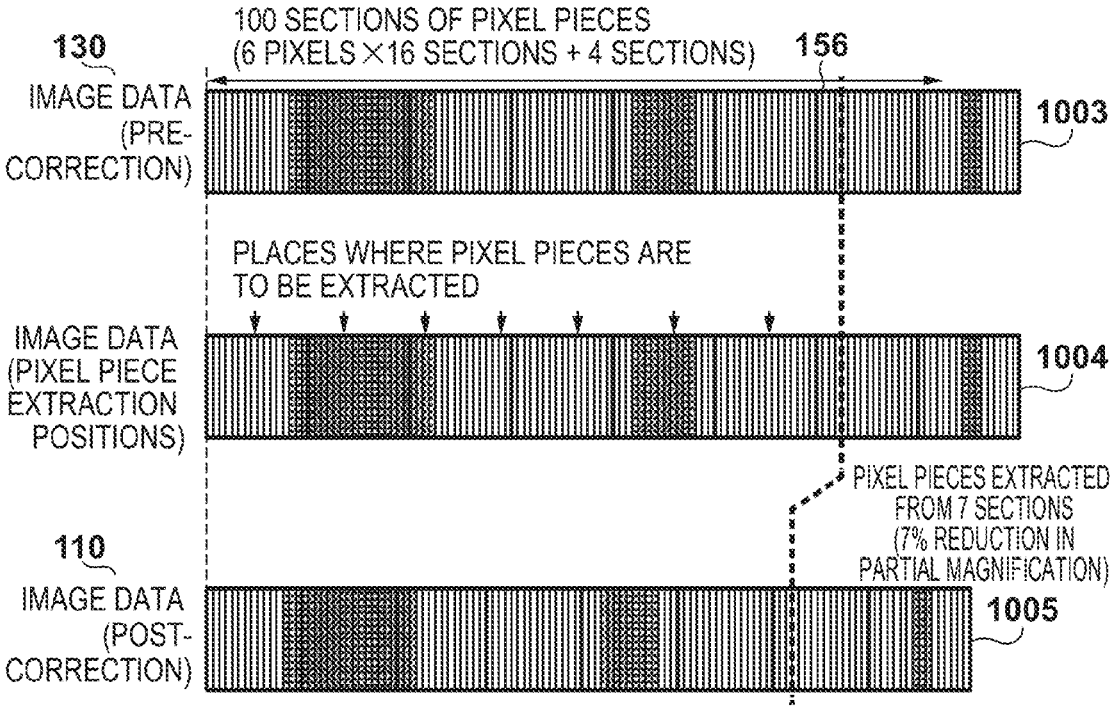

FIGS. 23A and 23B respectively show an example in which an image is lengthened by inserting pixel pieces and an example in which an image is shortened by extracting pixel pieces with respect to the serial signal 130, focusing on an 8-pixel area 158 in the main scanning direction of FIG. 22C. FIG. 23A is an example in which the partial magnification is increased by 8 percent. By inserting a total of eight pixel pieces into a group of 100 continuous pixel pieces at equidistant or substantially equidistant intervals, the pixel width can be lengthened in the main scanning direction by being changed so as to increase the partial magnification by 8 percent. Reference numeral 1000 denotes the pre-correction image data corresponding to the area 158. Reference numeral 1001 denotes the positions at which pixel pieces are to be inserted into the image data 1000. Reference numeral 1002 denotes the image data after inserting the pixel pieces at the positions shown in the image data 1001.

FIG. 23B is an example in which the partial magnification is reduced by 7 percent. By extracting a total of seven pixel pieces from a group of 100 continuous pixel pieces at equidistant or substantially equidistant intervals, the pixel width can be shortened in the main scanning direction by being changed so as to decrease the partial magnification by 7 percent. Reference numeral 1003 denotes the pre-correction image data corresponding to the area 158. Reference numeral 1004 denotes the positions at which pixel pieces are to be extracted from the image data 1003. Reference numeral 1005 denotes the image data after extracting the pixel pieces from the positions shown in the image data 1004.

In the partial magnification correction, by thus changing the pixel width such that the length in the main scanning direction is less than one pixel, latent images of the dot shapes corresponding to the pixels of image data can be formed substantially equidistantly with regard to the main scanning direction. Note that "substantially equidistantly with regard to the main scanning direction" includes the case where pixels are not disposed perfectly equidistantly. In other words, some variation in the pixel intervals as a result of performing partial magnification correction is acceptable, and the pixel intervals in a predetermined image height range need only be equidistant on average. As described above, when comparing the number of pixel pieces constituting two adjacent pixels in the case of inserting or extracting pixel pieces at equidistant or substantially equidistant intervals, the difference in the number of pixel pieces constituting the pixels is desirably restricted to 0 or 1. Variation in image density in the main scanning direction when compared with the original image data is suppressed by thus restricting the difference in the number of pixel pieces, enabling favorable image quality to be obtained. Also, pixel pieces may be inserted or extracted at the same positions for every scan line (line) or the positions may be shifted, with regard to the main scanning direction.

As described above, the scanning speed increases as the absolute value of the image height Y increases. In the partial magnification correction, at least one of the abovementioned insertion and extraction of pixel pieces is thus performed, such that the image becomes shorter (the length of one pixel become shorter) as the absolute value of the image height Y increases. This enables latent images corresponding to the pixels to be formed substantially equidistantly with regard to the main scanning direction, and partial magnification to be appropriately corrected. Also, as another method of performing partial magnification correction, there is also a method that involves changing a clock frequency in the main scanning direction, for example.

Next, a configuration in which change information indicating partial magnification characteristics (amount of change in scanning speed) is acquired will be described. The present embodiment will be described using a sensor 200 as an example of an information acquisition unit. Due to factors such as error at the time of attaching the optical scanning apparatus 400 to the image forming apparatus 50, the distance between the deflection surface (reflective surface) 405*a* of the deflector (polygon mirror) 405 and the scan surface 407 and the scanning angle in the main scanning direction change from partial magnification characteristic information first acquired (hereinafter, first partial magnification characteristic information).

Figure 24A:
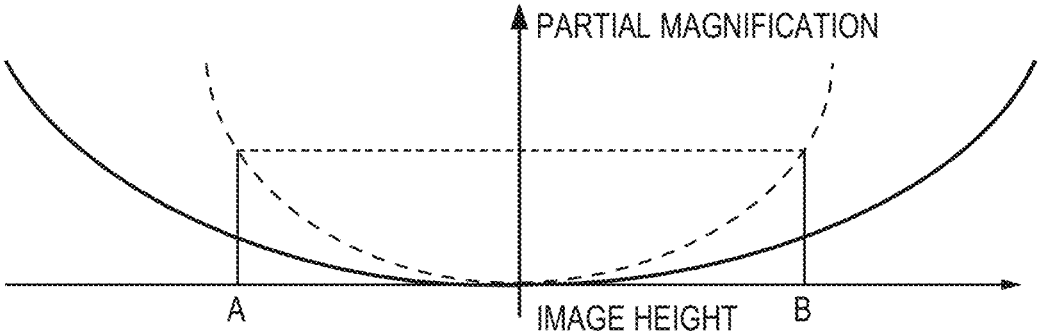
FIGS. 24A and 24B are diagrams showing partial magnification characteristics according to one embodiment.
Figure 24B:
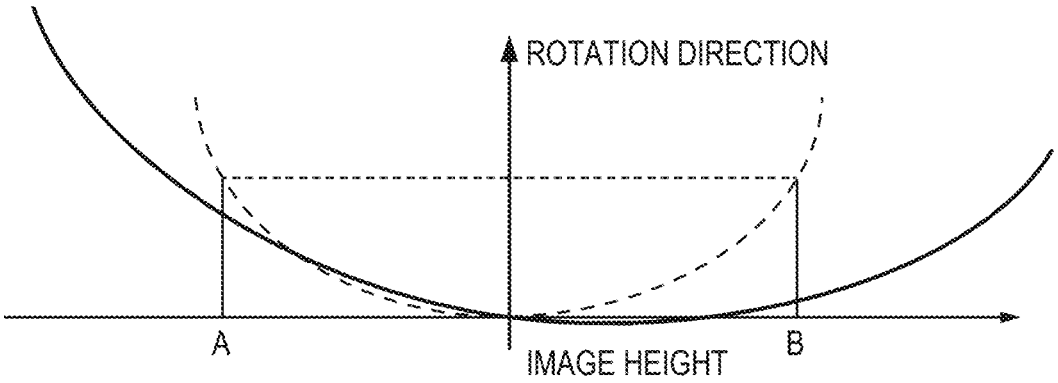

FIGS. 24A and 24B show the change from the first partial magnification characteristics (dashed line). Image height is shown on the horizontal axis and partial magnification is shown on the vertical axis. The solid line in FIG. 24A shows the case where the distance between the deflection surface 405*a* and the scan surface 407, for example, has widened uniformly in the main scanning direction. In this case, since the scanning speed at the same image height (e.g., image height point A) increases, the partial magnification characteristics change, as shown by the solid line in FIG. 24A, such that the partial magnification decreases as a whole when compared with the dashed line in FIG. 24A which indicates the first partial magnification characteristics.

The solid line in FIG. 24B shows the case where the optical scanning apparatus 400 has shifted in the rotation direction of the deflector 405. In this case, partial magnification characteristics are shown in which the scanning speeds at off-axis image heights differ at respective ends as shown by the solid line in FIG. 24B. For example, the partial magnifications differ due to the abovementioned shift, despite point A and point B being equidistant ends from the on-axis image height.

Figure 25A:
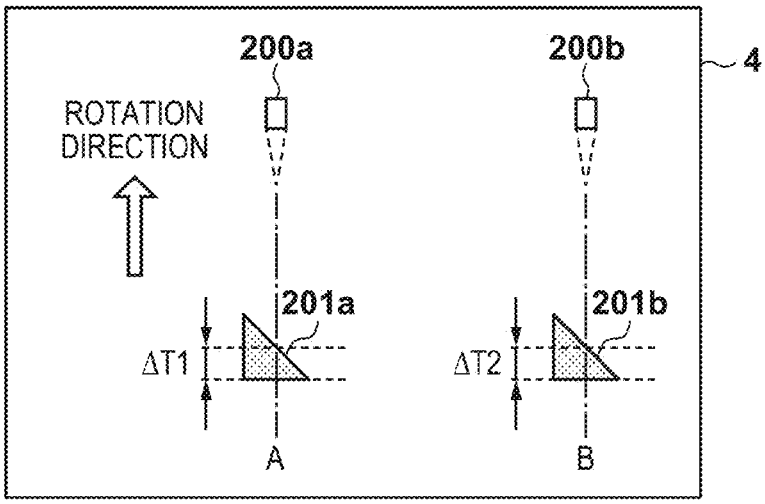
FIGS. 25A to 25C are detection configuration diagrams of a toner mark according to one embodiment.
Figure 25B:
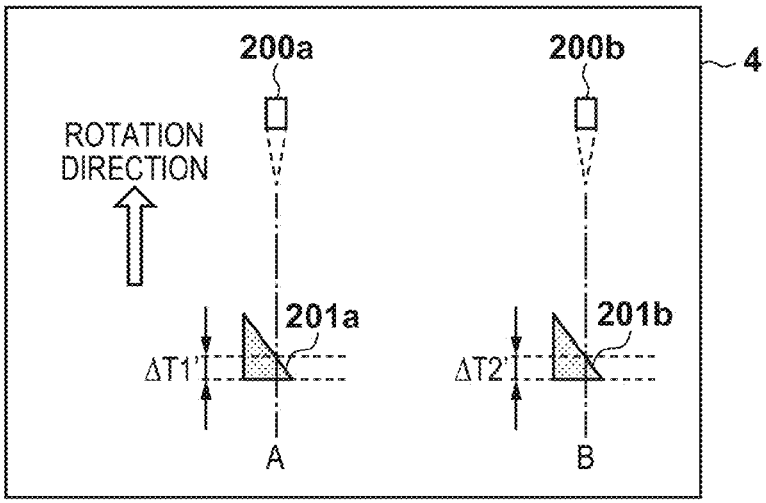
Figure 25C:
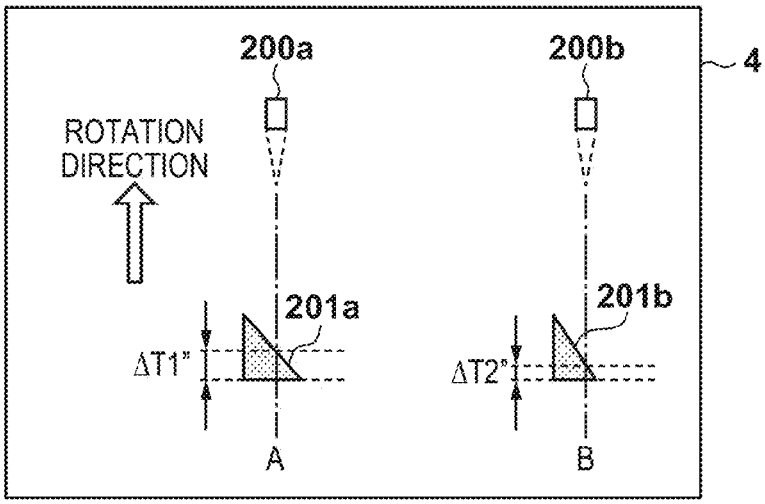

Since the characteristics may thus differ from the first partial magnification characteristic information due to factors such as aging or attachment error, it is necessary to acquire change information on the partial magnification characteristic information, in order to correct the partial magnification characteristics. FIGS. 25A to 25C show configurations for acquiring change information indicating the partial magnification characteristic information (amount of change in scanning speed) in the present embodiment. FIGS. 25A to 25C show the development of the scan surface 407 of the photosensitive member 4.

The photosensitive member 4 rotates upward in the diagrams. The sensors 200*a* and 200*b* are toner mark detection sensors that detect toner marks 201*a* and 201*b* on the photosensitive member 4, and are constituted by an LED and a phototransistor. The sensors 200*a* and 200*b* irradiate the photosensitive member 4 with light using the LED, and detect reflected light using the phototransistor. The intensity of the reflected light differs depending on the existence of toner, enabling toner to be detected, since the output of the phototransistor changes. In the present embodiment, a configuration for detecting the toner marks 201*a* and 201*b* on the photosensitive member 4 as a rotating body will be described. However, the present invention is not limited thereto, and a configuration may, for example, be adopted in which the toner marks 201*a* and 201*b* on the intermediate transfer belt are detected with the sensors 200*a* and 200*b*. The detected signals are sent to the CPU core 2 and processed.

The toner marks 201*a* and 201*b* are formed on a predetermined line parallel to the main scanning direction of the photosensitive member 4, at positions separated by a predetermined interval from the center of the line in different directions. Specifically, the toner marks 201*a* and 201*b* have a first contour and a second contour that is not parallel to the first contour. Furthermore, the first contour and the second contour of the toner marks 201*a* and 201*b* pass through detection positions of the sensors 200*a* and 200*b* due to the photosensitive member 4 rotating. In view of this, in the present embodiment, a time lag from a timing at which the first contour is detected to a timing at which the second contour is detected by the sensors 200*a* and 200*b* is acquired as the detection time of the marks.

Figure 26A:
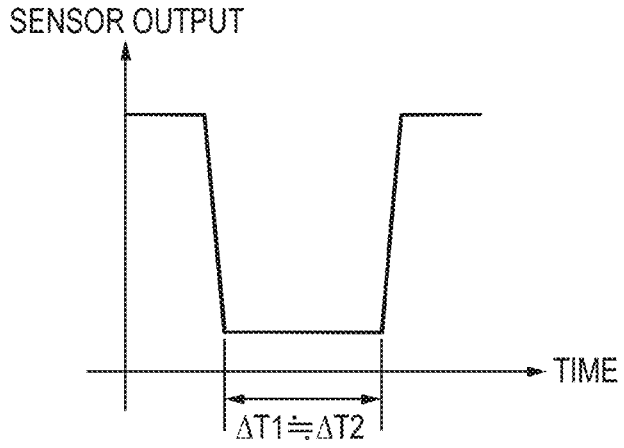
FIGS. 26A to 26C are diagrams showing waveforms of sensor output according to one embodiment.
Figure 26B:
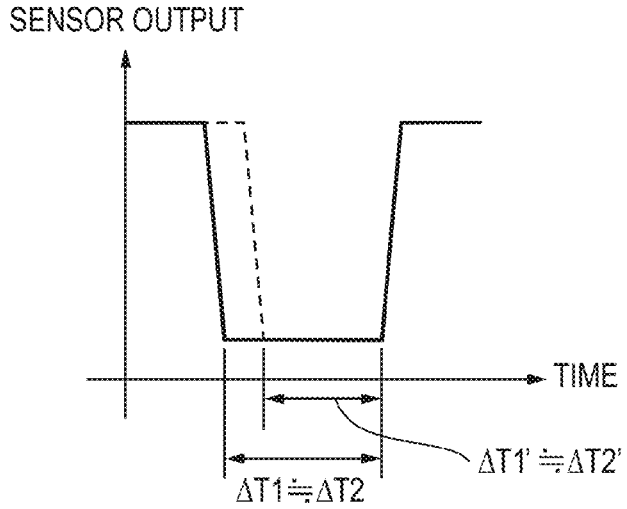
Figure 26C:
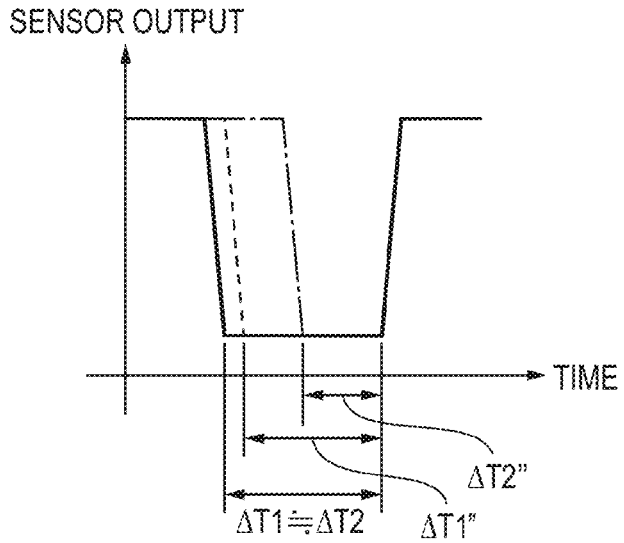

FIG. 25A shows the toner mark detection configuration when first partial magnification characteristic information is acquired. The sensors 200*a* and 200*b* are disposed at point A and point B. Here, the sensors 200*a* and 200*b* respectively detect the triangular toner marks 201*a* and 201*b*. which are first toner marks formed on the subscan near point A and point B. An exemplary detection waveform is shown in FIG. 26A. The graphs of FIGS. 26A to 26C show time on the horizontal axis and sensor output on the vertical axis. HIGH is output when the toner marks 201*a* and 201*b* are not being detected by the sensors 200*a* and 200*b*. and LOW is output when the toner marks 201*a* and 201*b* are being detected. ΔT1 and ΔT2 are respectively times (detection times) for the sensors 200*a* and 200*b* detecting the toner marks 201*a* and 201*b*. In detection performed early in the manufacturing process, ΔT1 and ΔT2 show substantially the same time. ΔT1 and ΔT2 may be calculated by the CPU core 2 or the like from waveform actually detected as described above, or may be values calculated from the revolution speed of the photosensitive member 4, the shapes of the toner marks 201*a* and 201*b*. the positions of the sensors 200*a* and 200*b*. or the like.

Next, the case where the distance between the deflection surface 405*a* and the scan surface 407 is widens uniformly in the main scanning direction, as shown by the solid line in FIG. 24A will be considered. A detection configuration is shown in FIG. 25B. The developing device 204, which is a toner mark formation unit, forms the toner marks 201*a* and 201*b* on the basis of the partial magnification characteristic information stored by the memory 304. However, since the distance between the deflection surface 405*a* and the scan surface 407 widens uniformly in the main scanning direction, the toner marks 201*a* and 201*b* are triangles in which the angle formed between the side in the main scanning direction and the oblique side is large compared with FIG. 25A. This is due to the distance between the deflection surface 405*a* and the scan surface 407 widening, and the scanning speed at off-axis image heights increasing. An exemplary detection waveform is shown in FIG. 26B. Since the distance between the deflection surface 405*a* and the scan surface 407 widens uniformly in the main scanning direction, times ΔT1' and ΔT2' for which the toner marks 201*a* and 201*b* are detected by the sensors 200*a* and 200*b* are substantially the same. However, it is evident that the values thereof have decreased compared with the previous ΔT1 and ΔT2. Therefore, the widening of the distance between the deflection surface 405*a* and the scan surface 407 can be detected from the time at which the first partial magnification characteristic information is acquired. A partial magnification X when read by the sensor 200*a* can be represented as $$X=Z\,\%\times(\Delta T1-\Delta T1')/\Delta T1\ [\%] \tag{5}$$

assuming that the partial magnification first read by the sensor 200*a* was Z %. Regions other than those detected by the sensors 200*a* and 200*b* need only be interpolated as appropriate. For example, the partial magnification characteristics are known to exhibit quadratic function characteristics, and thus interpolation is performed to follow the quadratic function. The change in the detected partial magnification characteristics is calculated by the CPU core 2, and stored in the memory 304 as new partial magnification characteristics (hereinafter, corrected partial magnification characteristics). Thereafter, image modulation can be performed using the corrected partial magnification characteristics.

As another example, the case where the optical scanning apparatus 400 has shifted in the rotation direction of the deflector (polygon mirror) 405 as shown in FIG. 24B will be considered. A detection configuration is shown in FIG. 25C. The developing device 204 forms the toner marks 201*a* and 201*b* on the basis of the first partial magnification characteristic information. However, since the optical scanning apparatus 400 has shifted to the rotation direction of the deflector (polygon mirror) 405, the toner marks 201*a* and 201*b* are triangles in which the angles formed between the side in the main scanning direction and the oblique side differ from each other. This is due to the scanning speeds at the maximum image height differing at respective ends (point A and point B), such as where the partial magnification characteristics are as shown in FIG. 24B. An exemplary detection waveform is shown in FIG. 26C. Times ΔT1" and ΔT2" for which the toner marks 201*a* and 201*b* were detected by the sensors 200*a* and 200*b* differs. Also, ΔT1">ΔT2". Therefore, the fact that the optical scanning apparatus 400 has shifted in the rotation direction of the deflector 405 after acquiring the first partial magnification characteristic information will be detected.

As described above, this image forming apparatus is provided with an imaging lens 406 that irradiates the photosensitive member 4 with light deflected by the deflector 405, and in which the scanning speed of laser light in the main scanning direction is not constant at different image heights on the surface of the photosensitive member 4. That is, a lens that does not have f-θ characteristics is provided. Also, this image forming apparatus detects, for each image height, the amount of change in scanning speed at the image height compared with the scanning speed at a reference image height on the surface of the photosensitive member 4, and controls the scanning speed of laser light in the main scanning direction to be constant at the respective image heights. Specifically, the image signal to be input to the light source is corrected, in accordance with the detected amount of change. The image forming apparatus according to the present embodiment is thereby able to acquire the amount of change in scanning speed (partial magnification) at each image height and correct the image signal in order to cancel the amount of change. That is, pixels can be disposed equidistantly using a lens that does not have f-θ characteristics, and shift due to factors such as aging and attachment error of the optical scanning apparatus can also be cancelled.

The present invention is not limited to the above embodiments, and various modifications can be made. For example, the toner marks 201*a* and 201*b* need only take a shape in which the slopes of the sides formed in the sub-scanning direction differ, such as a triangle or a trapezoid, for example. Also, although, in the present embodiment, a configuration was adopted in which there is also toner within the area of the triangles, similar effects are obtained even with toner marks 201*a* and 201*b* in which toner is only formed around the boundary of the triangles. Also, a configuration can be adopted in which toner marks 201*a* and 201*b* for color shift correction, which are second toner marks, are formed based on corrected partial magnification characteristics at the time of printing, and detected and corrected by sensors 200*a* and 200*b* or the like. Although, the present embodiment, an exemplary configuration for performing detection with two sensors 200*a* and 200*b* was shown, a configuration may be adopted in which three or more sensors or line sensors are disposed in order to correct partial magnification more accuracy.

Fifth Embodiment

Hereinafter, a fifth embodiment according to the present invention will be described. The present embodiment describes using the temperature sensor 220 as an example of an information acquisition unit. Configuration that is the same as the above fourth embodiment is given the same reference numerals and description thereof is omitted. In the case where the imaging lens 406 is fixed near the axis, the imaging lens 406 may expand from on the axis to off the axis due to the rise in temperature near the imaging lens 406. The temperature sensor 220 in FIG. 19 is a sensor serving as an information acquisition unit that detects the temperature around the optical scanning apparatus, and is a thermistor, for example. The temperature sensor 220 is installed near the optical scanning apparatus 400, and, in particular, detects the temperature near the imaging lens 406. Detected temperature information is sent to the CPU core 2, where the partial magnification characteristics are calculated according to the temperature, and stored in the memory 304. Assuming that the temperature has risen, for example, the imaging lens 406 generally expands, and thus the amount of change can be calculated according to the degree of expansion (expansion rate of lens) that is obtained from the detected temperature, and partial magnification can be corrected.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-031055. filed on Feb. 19, 2015. and Japanese Patent Application No. 2015-031056. filed on Feb. 19, 2015 which are hereby incorporated by reference herein in their entirety.

What is claimed is:

1. An image forming apparatus comprising:

a photosensitive member;

a scanning unit configured to form a latent image on the photosensitive member, by forming a light spot on the photosensitive member with light emitted by a light source and scanning the light spot, wherein a scanning speed at which the photosensitive member is scanned with the light spot changes within a scan line;

a developing unit configured to develop the latent image formed on the photosensitive member and to form a developer image;

a density detection unit configured to detect a density of the developer image formed on the photosensitive member;

a control unit configured to perform correction control of a luminance and a light-emitting time of the light source, according to a pixel to be exposed; and a holding unit configured to hold profile information indicating a change of the light spot due to an environment or due to a position of the pixel, wherein the holding unit is further configured to hold scanning information indicating the light-emitting time of the light source or the luminance of the light source with respect to the pixel, for correcting a change in the scanning time of the pixel due to a change in the scanning speed, and wherein the control unit is further configured to detect a change in the density of the developer image due to a scanning position on the photosensitive member, to generate the profile information based on the change in the density of the developer image, and to perform the correction control based on the scanning information and the profile information.

2. The image forming apparatus according to claim 1, wherein the scanning information indicates the light-emitting time of the light source with respect to the pixel, and the control unit is further configured to determine the luminance of the light source with respect to the pixel, such that the luminance of the light source with respect to the pixel increases when the light-emitting time of the light source with respect to the pixel is shortened, and to correct one or both of the determined luminance and the light-emitting time of the light source with respect to the pixel based on the profile information.

3. The image forming apparatus according to claim 2, wherein, with respect to a pixel that is different from a reference pixel, the light-emitting time of the light source with respect to the pixel that is indicated by the scanning information is shorter than the scanning time of the pixel.

4. The image forming apparatus according to claim 3, wherein the reference pixel is a pixel having a longest scanning time.

5. The image forming apparatus according to claim 3, wherein the reference pixel is a pixel in a middle of the scan line.

6. The image forming apparatus according to claim 1, wherein the scanning information indicates the luminance of the light source with respect to the pixel, and the control unit is further configured to determine the light-emitting time of the light source with respect to the pixel, such that the light-emitting time of the light source with respect to the pixel decreases when the luminance of the light source with respect to the pixel is increased, and to correct one or both of the determined light-emitting time and the luminance of the light source with respect to the pixel based on the profile information.

7. The image forming apparatus according to claim 6, wherein, with respect to a pixel that is different from a reference pixel, the light-emitting time of the light source with respect to the pixel determined based on the scanning information is shorter than the scanning time of the pixel.

8. The image forming apparatus according to claim 1, wherein the scanning information indicates the light-emitting time of the light source with respect to the pixel, and the light-emitting time of the light source with respect to the pixel is shown by a screen used for the pixel.

9. The image forming apparatus according to claim 8, wherein the screen is provided according to a gradation of the pixel.

10. The image forming apparatus according to claim 1, wherein the density detection unit is further configured to detect the density at a plurality of positions in a direction in which the photosensitive member is scanned by the scanning unit, and the control unit is further configured to detect a change in density due to the scanning position of the photosensitive member, based on the density of the developer image detected at each of the plurality of positions.

11. The image forming apparatus according to claim 10, wherein the density detection unit is further configured to detect the density at least at the middle and an end of the scan line of the scanning unit.

12. The image forming apparatus according to claim 1, further comprising:

a temperature detection unit configured to detect a temperature of the image forming apparatus, wherein the control unit is further configured to generate the profile information based on the temperature detected by the temperature detection unit.

13. An image forming apparatus comprising:

a photosensitive member;

a scanning unit configured to form a latent image on the photosensitive member, by forming a light spot on the photosensitive member with light emitted by a light source and scanning the light spot, wherein a scanning speed at which the photosensitive member is scanned with the light spot changes within a scan line;

a detection unit configured to detect an amount of change in scanning speed at another image height with respect to the scanning speed at a reference image height of the scan line; and a correction unit configured to correct an image signal to be input to the light source, based on the amount of change detected by the detection unit in order to control the scanning speed of the scan line to be constant, wherein the detection unit includes:

two sensors configured to detect a toner mark formed on the photosensitive member, and to detect two marks formed, on a line parallel to a main scanning direction of the photosensitive member, at positions separated by a predetermined interval from a center of the line in different directions; and a calculation unit configured to calculate the amount of change, based on a detection time between when the toner marks are detected by the two sensors.

14. The image forming apparatus according to claim 13, wherein the correction unit is further configured to correct the image signal at the other image height, so as to match the scanning time corresponding to one pixel of the image signal.

15. The image forming apparatus according to claim 14, wherein the correction unit is further configured to, in a case where one pixel in the image signal is represented by a predetermined number of pixel pieces, correct the image signal so as to match a scanning time obtained by extracting at least one pixel piece from the predetermined number of pixel pieces representing the one pixel at an image height at which the scanning speed is faster than at the reference image height, and correct the image signal so as to match a scanning time obtained by inserting at least one pixel piece into the predetermined number of pixel pieces representing the one pixel at an image height at which the scanning speed is slower than at the reference image height.

16. The image forming apparatus according to claim 15, wherein the correction unit is further configured to, in the case of extracting the pixel piece, invalidate a corresponding pixel piece of the image signal to be input to the light source.

17. The image forming apparatus according to claim 15, wherein the correction unit is further configured to, in the case of inserting the pixel piece, insert the same pixel piece as a pixel piece adjacent on an upstream side in a main scanning direction, as the pixel piece to be inserted, in the image signal to be input to the light source.

18. The image forming apparatus according to claim 13, further comprising:

a storage unit configured to store change information indicating an amount of change in the scanning speed at the other image height when the image forming apparatus is shipped, wherein the detection unit is further configured to, in a case where the detected amount of change differs from the amount of change indicated by the change information stored in the storage unit, update the change information stored in the storage unit by the detected amount of change, and the correction unit is further configured to correct the image signal to be input to the light source, in accordance with the amount of change indicated by the change information stored in the storage unit.

19. The image forming apparatus according to claim 13, wherein the toner marks each have a first contour and a second contour that is not parallel to the first contour, and the first contour and the second contour pass through a detection position of the sensors due to the photosensitive member rotating, and a time lag from a timing at which the first contour is detected until a timing at which the second contour is detected by the sensor is acquired as the detection time.

20. The image forming apparatus according to claim 13, wherein the scanning unit includes:

a deflector configured to deflect light emitted from the light source; and an optical system configured to irradiate the photosensitive member with the light deflected by the deflector and form the light spot, and the detection unit includes:

a sensor configured to detect a temperature of the optical system, a calculation unit configured to calculate the amount of change, based on an expansion rate of the optical system obtained from the temperature detect by the sensor.

21. The image forming apparatus according to claim 13, wherein the scanning unit includes:

a deflector configured to deflect light emitted from the light source; and an optical system configured to irradiate the photosensitive member with the light deflected by the deflector and form the light spot, and the reference image height is an on-axis image height corresponding to an optical axis of the optical system.

22. An image forming apparatus comprising:

a photosensitive member;

a scanning unit configured to form a latent image on the photosensitive member, by forming a light spot on the photosensitive member with light emitted by a light source and scanning the light spot, wherein a scanning speed at which the photosensitive member is scanned with the light spot changes within a scan line;

a control unit configured to perform correction control of a luminance and a light-emitting time of the light source, according to a pixel to be exposed;

a holding unit configured to hold profile information indicating a change of the light spot due to an environment or due to a position of the pixel; and a temperature detection unit configured to detect a temperature of the image forming apparatus, wherein the holding unit is further configured to hold scanning information indicating the light-emitting time of the light source or the luminance of the light source with respect to the pixel, for correcting a change in the scanning time of the pixel due to a change in the scanning speed, and the control unit is further configured to generate the profile information based on the temperature detected by the temperature detection unit, and to perform the correction control based on the scanning information and the profile information.

23. The image forming apparatus according to claim 22, wherein the scanning information indicates the light-emitting time of the light source with respect to the pixel, and the control unit is further configured to determine the luminance of the light source with respect to the pixel, such that the luminance of the light source with respect to the pixel increases when the light-emitting time of the light source with respect to the pixel is shortened, and to correct one or both of the determined luminance and the light-emitting time of the light source with respect to the pixel based on the profile information.

24. The image forming apparatus according to claim 23, wherein, with respect to a pixel that is different from a reference pixel, the light-emitting time of the light source with respect to the pixel that is indicated by the scanning information is shorter than the scanning time of the pixel.

25. The image forming apparatus according to claim 24, wherein the reference pixel is a pixel having a longest scanning time.

26. The image forming apparatus according to claim 24, wherein the reference pixel is a pixel in a middle of the scan line.

27. The image forming apparatus according to claim 22, wherein the scanning information indicates the luminance of the light source with respect to the pixel, and the control unit is further configured to determine the light-emitting time of the light source with respect to the pixel, such that the light-emitting time of the light source with respect to the pixel decreases when the luminance of the light source with respect to the pixel is increased, and to correct one or both of the determined light-emitting time and the luminance of the light source with respect to the pixel based on the profile information.

28. The image forming apparatus according to claim 27, wherein, with respect to a pixel that is different from a reference pixel, the light-emitting time of the light source with respect to the pixel determined based on the scanning information is shorter than the scanning time of the pixel.

29. The image forming apparatus according to claim 22, wherein the scanning information indicates the light-emitting time of the light source with respect to the pixel, and the light-emitting time of the light source with respect to the pixel is shown by a screen used for the pixel.

30. The image forming apparatus according to claim 29, wherein the screen is provided according to a gradation of the pixel.

* * * * *